US011485002B2

(12) United States Patent
Stokes et al.

(10) Patent No.: US 11,485,002 B2
(45) Date of Patent: Nov. 1, 2022

(54) VIBRATION REDUCTION MECHANISM FOR A STRIKING TOOL

(71) Applicant: Fiskars Brands, Inc., Madison, WI (US)

(72) Inventors: Steven Stokes, Fitchburg, WI (US); Aaron Honadel, Ixonia, WI (US)

(73) Assignee: Fiskars Brands, Inc., Madison, WI (US)

( * ) Notice: Subject to any disclaimer, the term of this patent is extended or adjusted under 35 U.S.C. 154(b) by 488 days.

(21) Appl. No.: 14/798,097

(22) Filed: Jul. 13, 2015

(65) Prior Publication Data

US 2016/0008966 A1 Jan. 14, 2016

Related U.S. Application Data

(60) Provisional application No. 62/024,153, filed on Jul. 14, 2014.

(51) Int. Cl.
*B25D 1/12* (2006.01)
*B25G 1/01* (2006.01)
*B26B 23/00* (2006.01)

(52) U.S. Cl.
CPC ..... *B25D 1/12* (2013.01); *B25G 1/01* (2013.01); *B26B 23/00* (2013.01)

(58) Field of Classification Search
CPC ... B25D 1/12; B25D 1/00; B25D 1/02; B25G 1/01; B25G 1/10; B26B 23/00
USPC ..... 81/22
See application file for complete search history.

(56) References Cited

U.S. PATENT DOCUMENTS 967,703 A * 8/1910 Bagnall ..... F16B 4/004 403/243
2,067,751 A * 1/1937 Beegle ..... B25G 3/32 403/227
2,603,260 A * 7/1952 Floren ..... B25G 1/01 81/22
2,702,060 A * 2/1955 Bonnesen ..... B25D 1/00 81/22
2,754,863 A * 7/1956 Yearley ..... B25D 1/00 81/22
2,873,053 A 2/1959 Seegrist
(Continued)

FOREIGN PATENT DOCUMENTS

CN 2839704 11/2006
DE 102012003927 A1 9/2013
(Continued)

OTHER PUBLICATIONS

International Search Report and Written Opinion, PCT/US2015/040176, Fiskars Brands, Inc., 11 pages (dated Sep. 30, 2015).
(Continued)

*Primary Examiner* — Monica S Carter
*Assistant Examiner* — Marcel T Dion
(74) *Attorney, Agent, or Firm* — Foley & Lardner LLP

(57) ABSTRACT

Various embodiments relate to a vibration reduction mechanism for a hand operated striking tool. The vibration reduction mechanism includes a collar coupled to a portion of a handle of the hand-operated striking tool; at least one sleeve interposed over the collar; and at least one pin interconnecting the collar to the handle, wherein the at least one pin retains a position of the collar near a first end of the handle.

10 Claims, 17 Drawing Sheets

(56) References Cited

U.S. PATENT DOCUMENTS 3,234,981 A * 2/1966 Finke ..... B25D 1/00 81/19
3,394,745 A * 7/1968 Kuchins ..... B25G 3/02 403/373
3,578,825 A * 5/1971 Merrow ..... B25D 1/00 403/252
3,704,734 A * 12/1972 Soto ..... B25G 3/02 81/22
3,877,826 A * 4/1975 Shepherd, Jr. ..... B25G 3/34 403/267
4,089,356 A * 5/1978 O'Connor ..... B25G 3/10 81/22
4,266,588 A 5/1981 Tudisco
4,353,550 A * 10/1982 Krosnick ..... A63B 59/80 473/527
5,123,303 A * 6/1992 Lee ..... B25D 1/00 254/26 R
5,280,739 A 1/1994 Liou
5,490,437 A 2/1996 Hebert et al.
5,657,674 A * 8/1997 Burnett ..... B25D 1/12 81/20
5,704,259 A 1/1998 Riehle
5,911,795 A 6/1999 Tucker
5,916,338 A 6/1999 Bergkvist et al.
5,992,270 A 11/1999 Hedelin et al.
6,128,977 A * 10/2000 Gierer ..... B25D 1/12 7/144
6,202,511 B1 3/2001 Murray et al.
6,220,128 B1 4/2001 Hu
6,223,627 B1 5/2001 Jan et al.
6,311,369 B1 11/2001 Ryu
6,386,071 B1 5/2002 McIntyre
6,457,384 B1 * 10/2002 Cox ..... B25D 1/02 81/22
6,463,832 B1 * 10/2002 Cox ..... B25D 1/02 81/22
6,467,376 B1 * 10/2002 Wu ..... B25G 1/01 81/22
6,477,922 B1 * 11/2002 Burnett ..... B25D 1/00 81/20
6,615,692 B2 9/2003 Hu
6,619,408 B1 9/2003 Lai
6,763,747 B1 7/2004 Gierer et al.
6,945,138 B1 * 9/2005 Kreitzer ..... B25D 1/045 30/308.1
7,016,867 B2 * 3/2006 Lyden ..... A43B 1/0081 36/37
7,107,874 B1 * 9/2006 Chen ..... B25D 1/02 30/308.3
7,143,667 B2 12/2006 Deros et al.
7,320,266 B1 1/2008 Mueller
7,448,299 B1 * 11/2008 Chen ..... B25D 1/14 81/22
8,359,949 B2 1/2013 Onello et al.
8,499,665 B2 * 8/2013 St. John ..... B25D 1/045 81/22
8,893,585 B2 11/2014 Descombes et al.
2003/0196521 A1 * 10/2003 Yang ..... B25D 1/12 81/22
2006/0021473 A1 * 2/2006 Deros ..... B25G 1/01 81/20
2009/0078090 A1 3/2009 Halder et al.
2014/0165787 A1 * 6/2014 Lombardi ..... B25G 1/02 81/22
2014/0230616 A1 8/2014 Descombes et al.
2014/0260812 A1 * 9/2014 Chang ..... B25G 3/38 81/22

FOREIGN PATENT DOCUMENTS

EP 2 743 037 A2 6/2014
KR 20080071043 A 8/2008
RU 107998 9/2011

OTHER PUBLICATIONS

English-language machine translation of DE 102012003927, Zimmer, Klaus et al. (Sep. 5, 2013).
English-language machine translation of KR 20080071043, Chol, Do Su (Aug. 1, 2008).
International Preliminary Report on Patentability, PCT/US2015/040176, Fiskars Brands, Inc., 9 pages (dated Jan. 28, 2017).
Translation of Office Action for Russian Application No. 2017104239, dated Mar. 30, 2018, 5 pages.
English Translation of Office Action Received for Chinese Application No. 201580049275.7, dated Aug. 8, 2019, 14 pages.
Examination Report Received for European Application No. 15747279.6, dated Apr. 22, 2021, 7 pages.

* cited by examiner

VIBRATION REDUCTION MECHANISM FOR A STRIKING TOOL

CROSS-REFERENCE TO RELATED APPLICATION

This application claims the benefit of U.S. Provisional Patent Application No. 62/024,153, filed Jul. 14, 2014, entitled "VIBRATION REDUCTION MECHANISM FOR A STRIKING TOOL," which is incorporated herein by reference in its entirety.

FIELD

The present disclosure relates to hand operated striking tools. More particularly, the present disclosure relates to a vibration reduction mechanism for hand operated striking tools.

BACKGROUND

This section is intended to provide a background or context to the disclosure recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is generally known to provide a hand operated striking tool. Hand operated striking tools are used in a variety of applications, such as inserting fasteners (e.g., nails) and cutting materials, such as wood. Typically, the tool includes two main components: a handle and a tool head connected to the handle. The structure of the tool head defines the type of striking tool (e.g., an axe, a hammer, a sledgehammer, etc.). In operation, a user holds the handle in their palm and swings the tool to cause the tool head to impact a work piece. For example, when structured as a hammer, the user swings the hammer to drive an object, such as a nail. Depending on the size of the tool, a user may use both hands to generate additional force for the strike or impact.

SUMMARY

According to one embodiment, a hand operated striking tool includes a tool head with a hole; a handle with a first sleeve and a second sleeve interposed over the first sleeve; and a pin structured to retain the sleeves near a first end of the handle. A portion of the handle with the sleeves is disposed within the hole of the tool head to couple the tool head to the handle. The sleeves are formed from a resilient shock absorbing material and are structured to isolate and dampen vibrational frequencies resulting from operation of the tool (e.g., an impact of the tool with a work piece). In turn, a relatively smaller amount of vibrational frequencies are transmitted to the user, which eases operation of the tool.

Another embodiment relates to a hand-operated striking tool. The hand-operated striking tool includes a handle having a first end portion and a second end portion, wherein the second end portion defines a user interface portion of the handle. The hand-operated striking tool also includes a tool head defining a hole. The hand-operated striking tool further includes a vibration reduction mechanism positioned on the first end portion of the handle, wherein the vibration reduction mechanism is disposed between each of the handle and the tool head, and wherein the vibration reduction mechanism fits substantially within the hole of the tool head to form an intermediary between the tool head and the handle.

Still another embodiment relates to a hand-operated striking tool. The hand-operated striking tool includes a handle having a user interface portion; a tool head defining a tapered hole having a first taper angle and a second taper angle, wherein the first taper angle is different from the second taper angle; and a vibration reduction mechanism positioned in between the tool head and the handle. According to one embodiment, the vibration reduction mechanism includes a first sleeve and a second sleeve interposed over the first sleeve, wherein the second sleeve engages with the tapered hole.

Yet another embodiment relates to a vibration reduction mechanism for a hand-operated striking tool. The vibration reduction mechanism includes a collar substantially surrounding and coupled to a handle of the hand-operated striking tool; a first sleeve interposed over the collar; a second sleeve interposed over the first sleeve; and a pin interconnecting each of the collar and the first and second sleeves, wherein the pin retains a position of the first and second sleeves near a first end of the handle.

Another embodiment relates to a hand-operated striking tool. The hand-operated striking tool includes a handle having a user interface portion; a tool head defining a tapered hole; and a vibration reduction mechanism positioned in between the tool head and the handle. According to one embodiment, the vibration reduction mechanism includes a collar and at least one sleeve interposed over the collar, wherein an outer sleeve of the at least one sleeve engages with the tapered hole of the tool head.

A further embodiment relates to a vibration reduction mechanism for a hand-operated striking tool. The vibration reduction mechanism includes a collar coupled to a portion of a handle of the hand-operated striking tool; at least one sleeve interposed over the collar; and at least one pin interconnecting the collar to the handle, wherein the at least one pin retains a position of the collar near a first end of the handle.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

DETAILED DESCRIPTION

Referring to Figures generally, a hand operated striking tool with a vibration reduction mechanism is shown according to the various embodiments herein. The hand operated striking tool may be structured as any type of striking tool including, but not limited to, a hammer, an axe, a sledgehammer, variations thereof, and the like. Generally, the striking tool includes a handle and a tool head (e.g., a hammer head). According to the present disclosure, a vibration reduction mechanism may be disposed as an intermediary between the tool head and the handle. The vibration reduction mechanism is structured to isolate and dampen vibrational frequencies resulting from the impact of the striking tool with a work piece. As an intermediary, the vibration reduction mechanism decouples the tool head from the handle, which also substantially blocks vibrations resulting from the impact from being transferred to the handle. Accordingly, a user of the tool may experience a reduction in unpleasant and sometimes painful vibrations, pulsations, and tremors caused by each strike of the tool. These and other features of the disclosure are described more fully herein.

Figure 1:
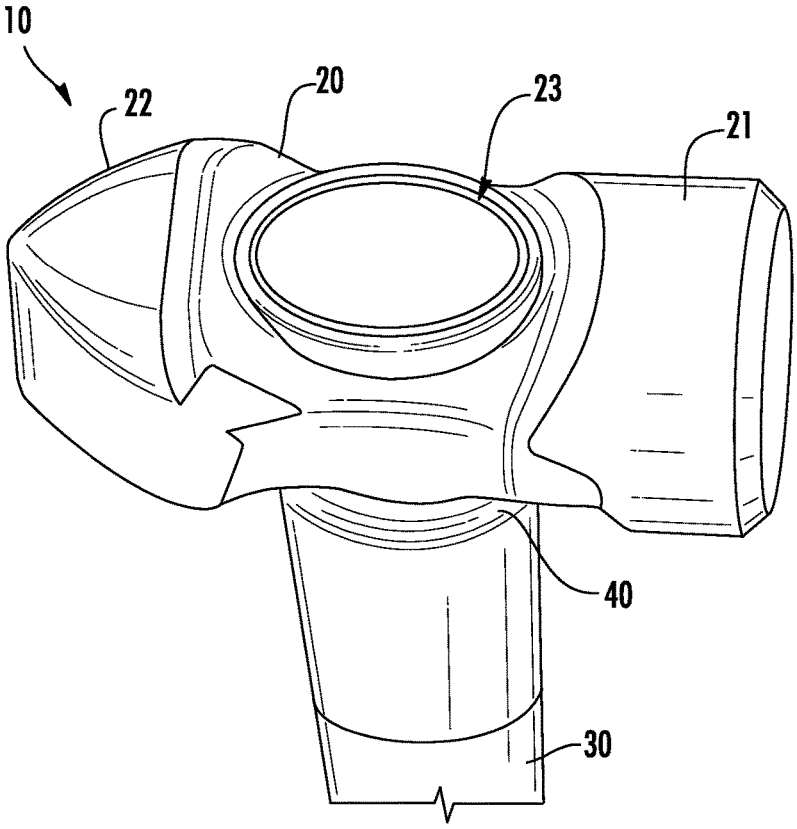
FIG. 1 is an isometric view of a hand operated striking tool, shown as a sledgehammer, according to an exemplary embodiment.

Referring now to FIG. 1, an isometric view of a hand operated striking tool 10 (the "tool") is shown according to one embodiment. As shown, the tool 10 is structured as a sledgehammer. However, the tool 10 may be structured as any type of striking tool including, but not limited to, a hammer, an axe, a pick-axe, variations thereof, and the like. The tool 10 includes a tool head 20, a handle 30, and a vibration reduction mechanism 40 disposed as an intermediary between the tool head 20 and the handle 30, wherein the vibration reduction mechanism 40 is structured to, among other purposes, couple the tool head 20 to the handle 30.

As shown, the tool head 20 includes an impact end 21 and a tang 22 (or, back end, etc.). The tool head 20 is also shown to define a hole 23 positioned between the impact end 21 and the back end 22. The impact end 21 is designed to strike the work piece during operating of the tool 10, such that the impact end 21 may be flat (as shown), sharply-edged, or any other structure depending on the configuration of the tool 10. In the embodiment depicted, the hole 23 is structured as a through hole in the tool head 20 (i.e., goes completely through the head 20) (see, FIGS. 2-3). As described more fully herein, in one embodiment, the hole 23 is tapered to substantially match or align with the tapered outer layer of the outer sleeve (e.g., second sleeve 45) of the vibration reduction mechanism 40 to enable the formation of a wedge-relationship between the surface of the hole 23 and the second sleeve 45 (see, e.g., FIG. 8).

Figure 2:
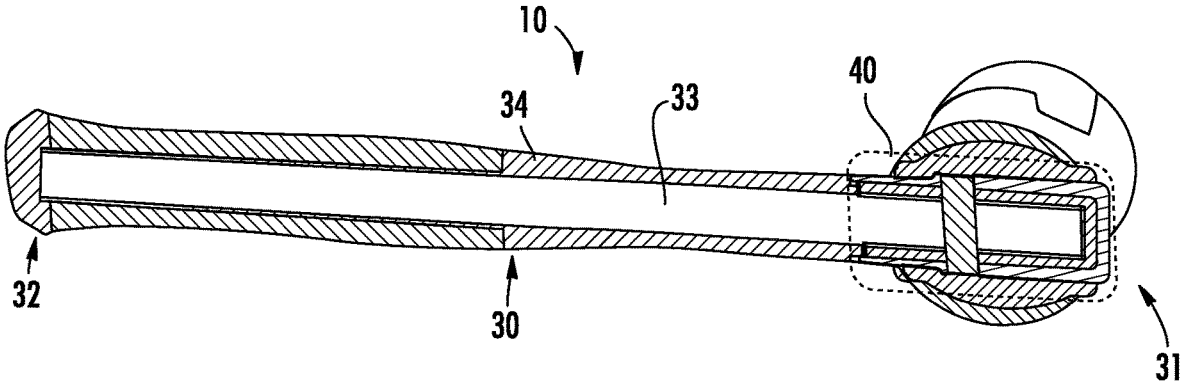
FIG. 2 is a cross-sectional view of a hand operated striking tool, shown as a sledgehammer, according to an exemplary embodiment.

In regard to the handle 30 and with reference now to FIG. 2, the handle 30 is shown to include a first end 31 and a second end 32. A portion proximate the first end 31 is coupled to the vibration reduction mechanism 40 while a portion of the handle 30 proximate the second end 32 is configured as the user-interface portion (e.g., a grab area for the user). More particularly, at or near the portion proximate the second end 32, the user grabs and holds onto an outer surface 34 (e.g., substrate, grip area, etc.) of the handle 30 to control the tool 10. The outer surface 34 surrounds or substantially surrounds the handle core 33 and may be formed from any suitable handle surface material, such as rubber, plastic, wood, some combination therewith, etc. In one embodiment, the handle core 33 is formed from a fiberglass material. According to various other embodiments, the handle core 33 is formed from any hard, yet durable material substantially capable of withstanding repeated impacts of the tool 10 with a work piece. For example, the handle core 33 may be constructed from any material typically used with handles for hand operating striking tools.

Figure 3:
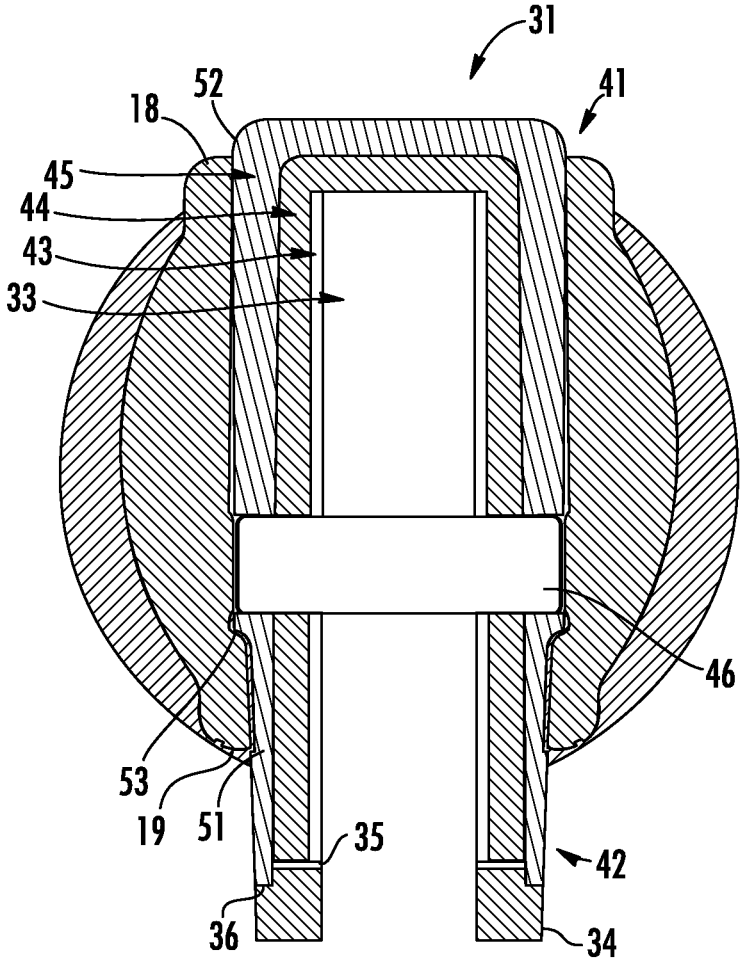
FIG. 3 is another cross-sectional view of a hand operated striking tool, shown as a sledgehammer, according to an exemplary embodiment.
Figure 4:
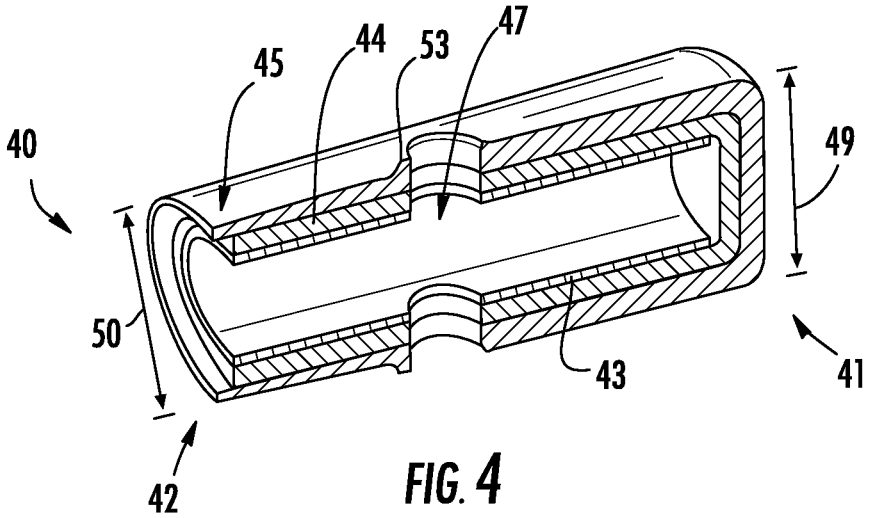
FIG. 4 is a schematic image of a sleeve assembly for a hand operated striking tool, according to an exemplary embodiment.

Referring now collectively to FIGS. 3-4, the vibration reduction mechanism 40 and its interaction with the handle 30 and tool head 20 are shown according to one embodiment. Relative to a top end 41 and a bottom end 42 of the vibration reduction mechanism 40, the vibration reduction mechanism 40 includes a collar 43 and a sleeve assembly coupled to the collar 43. Each of the first sleeve 44 and second sleeve 45 cap off/fit over a top portion of the core 33. In this regard and as shown, the sleeve assembly comprising the first and second sleeves 44, 45 is substantially U-Shaped (e.g., channel shaped), with the open end of the "U" being proximate the bottom end 32. In other embodiments, other shapes and configurations may be used with the sleeve assembly.

As shown and in this example configuration, the sleeve assembly includes an inner first sleeve 44 interposed over the collar 43 and an outer second sleeve 45 interposed over the inner first sleeve 44. The vibration reduction mechanism 40 is attached over a portion of the hand core 33 proximate the first end 31. The vibration reduction mechanism is also shown to include a pin 46 (e.g., locking mechanism or device, holding mechanism or device, fastener, coupling device, etc.). The vibration reduction mechanism 40 defines a hole 47 through the collar 43, first sleeve 44, and second sleeve 45. The hole 47 permits and allows insertion of the pin 46. As shown in FIG. 3, the pin 46 also goes through the handle core 33. As a result, the pin 46 securably fastens and retains the mechanism 40 (i.e., the sleeves and collar) in a desired position on the handle 30.

The collar 43 is structured to encapsulate or substantially encapsulate an upper portion of the handle core 33 proximate the first end 31 of the handle 30. The collar 43 substantially surrounds the portion of the core 33 disposed within the hole 23 and a portion of the core 33 not within the hole 23 when the tool 10 is assembled (i.e., a portion of the core 33 that extends above the tool head 20). In one embodiment, the collar 43 is formed from a metal-based material, such as steel. In various other embodiments, the collar 43 is formed from any substantially rigid material that is able to substantially protect the core 33 (e.g., from cracking, splitting, rupture, etc.).

The first sleeve 44 is structured to encapsulate or substantially encapsulate the collar 43. According to one embodiment, the first sleeve 44 and collar 43 extend a substantially similar distance from the first end 31 of the handle 30 towards the second end 32. According to various other embodiments, the first sleeve 44 and collar 43 extend different lengths.

As shown in FIGS. 3-4, the second sleeve 45 is structured to encapsulate or substantially encapsulate the first sleeve 44. In the example depicted, the second sleeve 45 extends relatively closer to the second end 32 of the handle 30 than either of the first sleeve 44 and the collar 43. However, in various other embodiments, the relative lengths of the collar 43, first sleeve 44, and second sleeve 45 may be different, such that the relative lengths are highly configurable and may vary from application to application.

Furthermore, while the collar 43 is shown to be relatively less thick than either of the first and second sleeves 44, 45, and the first sleeve 44 is shown to be relatively less thick than the second outer sleeve 45, this configuration is for illustrative purposes only. In another embodiment, each of the sleeves may be of a uniform or consistent thickness where the thickness may match or not match that of the collar. In still another embodiment, each of the sleeves and collars may be of a different thickness, or cascade in thickness from less thick to more thick from outside-to-inside (towards the core). All such variations are intended to fall within the spirit and scope of the present disclosure.

The first and second sleeves 44, 45 are structured to provide damping for high and low vibrational frequency bands caused from operation of the tool 10. Accordingly, the first and second sleeves 44, 45 isolate, absorb, and otherwise dampen high and low frequency vibrational bands to thereby reduce transmission of those frequency bands through the handle 30 to the user.

According to one embodiment, the first sleeve 44 has a relatively lower Shore durometer than the second sleeve 45. As "durometer" is a measure of hardness, a higher durometer number corresponds with a harder material. In this configuration, the second sleeve 45 is relatively harder than the first sleeve 44. As currently believed or understood by the Applicant, the relatively harder outer sleeve 45 is intended to reduce high frequency vibrations and provide durability to the mechanism 40 while the relatively softer inner sleeve 44 is intended to reduce or dampen low frequency vibrations. In one example embodiment, the durometer for the first sleeve 44 is approximately 30-60 Shore A (Shore A refers to a type of a durometer test set-up per American Society for Testing and Materials (ASTM) D2240 standards) while the durometer for the second sleeve 45 is approximately 60-100 Shore A. According to one embodiment, the first and second sleeves 44, 45 are formed from a thermoplastic rubber, elastomer, or urethane. According to various other embodiments, the first and second sleeves 44, 45 are formed from any resilient shock absorbing material intended to absorb or dampen various vibrational frequency bands.

In various other alternate embodiments, a single layer of vibration isolating material of a single durometer (i.e., one sleeve) may be used rather than the two-sleeve assembly shown in the Figures. In other embodiments, more than two sleeves may be used with a variety of durometer traits. Similarly, the collar may be removed and more than one pin may be used to connect the mechanism to the handle. As such, although only a few different mechanism and assembly configuration variations are described herein, a wide variety of other possible variations are possible, with all such variations intended to be within the spirit and scope of this disclosure.

Accordingly, with the structure of the individual components of the tool 10 mostly described above, referring now to FIGS. 1-13 and particularly FIGS. 5-13, assembly of the tool 10 may be described as follows according to one embodiment.

Figure 5:
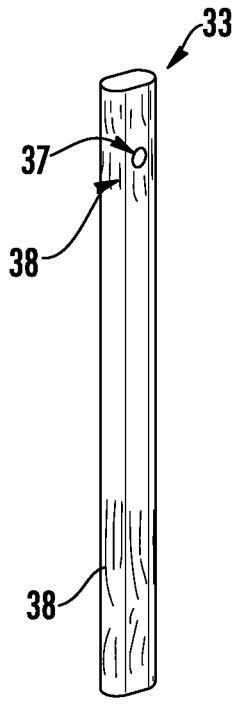
FIG. 5 is a schematic image of a handle core for a hand operated striking tool, according to an exemplary embodiment.

First, as shown in FIG. 5, the hole 38 in the handle core 33 is made. In this example, the hole 37 is drilled in the handle core 33 near the first end 31 (i.e., a first end portion of the handle core 33). However, in other embodiments, the hole 37 may be constructed in the core 33 according to any manufacturing process (e.g., molded in the core 33, etc.). As also shown in FIG. 5, the core 33 also includes scoring 38 (e.g., etching, or other marking up) near the first and second ends 31, 32. In other embodiments, the scoring 38 may be performed throughout the length of the core 33. The scoring and/or etching enable and facilitate adhesion of the collar 43 to the core 33 near the first end 31 and adhesion from the outer surface 34 to the core 33 near the second end 32 via a bonding material or agent (e.g., glue, polymer adhesion, etc.). In other embodiments, the scoring 38 and/or etching may be excluded and other coupling techniques utilized (e.g., interference fits, fasteners, etc.). Further, while the core 33 is shown as an elliptic cylinder, in other embodiments, the core 33 may be configured as any shape including, but not limited to, cylindrical, cubical, and so on.

Figure 6:
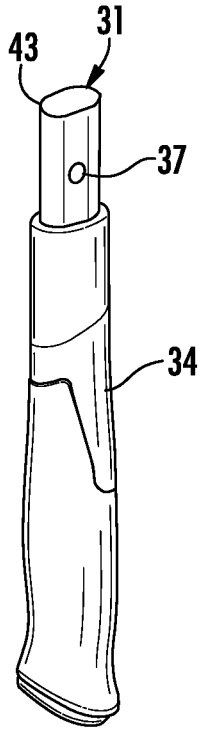
FIG. 6 is a schematic image of a handle core coupled to an outer surface or substrate for a hand operated striking tool, according to an exemplary embodiment.

Second, as shown in FIG. 6, the outer surface 34 is attached to the core 33. Attaching of the outer surface 34 to the core 33 may be via any one of a number of different manufacturing and/or attaching techniques. For example, in the example depicted, a bonding agent may be used to bond the outer surface 34 to the core (e.g., via the lower scoring 38). In another embodiment, a fastener may be used to attach the outer surface 34 to the core 33. In still another embodiment, the outer surface 34 may be molded around the core 33 (e.g., via one or more manufacturing and/or assembly steps). All such variations are intended to fall within the spirit and scope of the present disclosure.

Third, and as also shown in FIG. 6, the collar 43 is attached to the handle core 33 at a part near the first end 31. Attachment of the collar 43 to the handle core 33 may be via any number and type of manufacturing/assembly processes including, but not limited to, a bonding agent using the upper scoring 38 (see FIG. 5) (e.g., glue, polymer adhesion, etc.), and/or any other attachment process. In another embodiment, the vibration reduction mechanism 40, including the collar 43, are assembled as one unit and then attached to the core 33. As mentioned above, the scoring and/or etching used in combination with a bonding material may securably attach the core 33 to the collar 43.

Figure 7A:
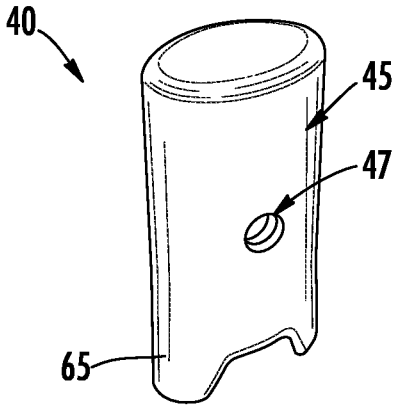
FIGS. 7A-7B are perspective (FIG. 7A) and cross-sectional (FIG. 7B) views of a sleeve assembly for a vibration reduction mechanism for a hand operated striking tool, according to an exemplary embodiment.
Figure 7B:
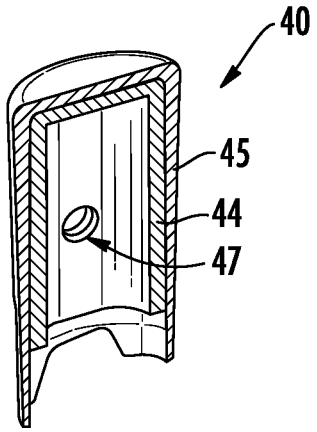

FIGS. 7A-7B depict the sleeve assembly of the vibration reduction mechanism 40 prior to assembly to the handle core 33, according to one embodiment. FIG. 7A depicts a front, top, perspective view of the sleeve assembly of the mechanism 40, while FIG. 7B depicts a cross-sectional view of the sleeve assembly of the mechanism 40. As shown, in this configuration, the collar 43 is excluded; rather, the collar 43 is coupled separately to the core 33 as shown in FIG. 6. The sleeve assembly comprising the sleeves 44, 45 form a cap for the tool 10 (e.g., the U or channel shape characteristic of the sleeve assembly, as described herein above). The sleeves 44, 45 may be combined via any type of assembly process. In one embodiment, the sleeves 44, 45 are bonded together via at least one of chemically, physically (e.g., a fastener, interference fit, etc.), or both.

Figure 8:
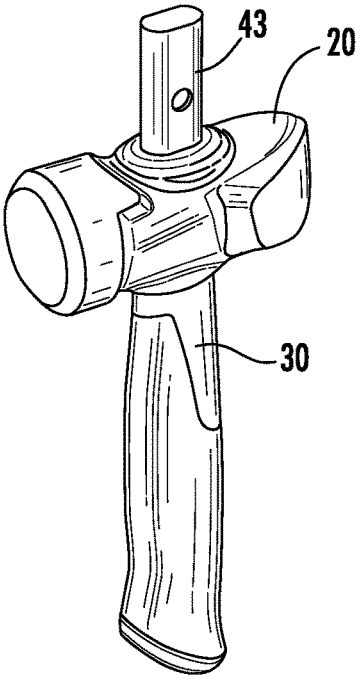
FIG. 8 is a perspective view of a tool head and handle for a hand operated striking tool prior to attachment of a sleeve assembly for a vibration reduction mechanism, according to an exemplary embodiment.

Fourth, the top end (with the hole 37) of the handle core 33 is inserted through a bottom opening of the hole 23 in the tool head 20 (FIG. 8). As mentioned above, in some embodiments, the collar 43 may already be attached to a portion of the core 33 proximate the first end 31 as shown in FIG. 8. By insertion of the first end 31 through the hole 23, the outer surface 34 is substantially free from assembly constraints because the outer surface 34 may not also need to be put through the hole 23. Accordingly, a wide variety of shapes and sizes of the outer surface 34 are possible. These may be desirable for meeting or adhering to various ergonomic considerations.

Figure 9:
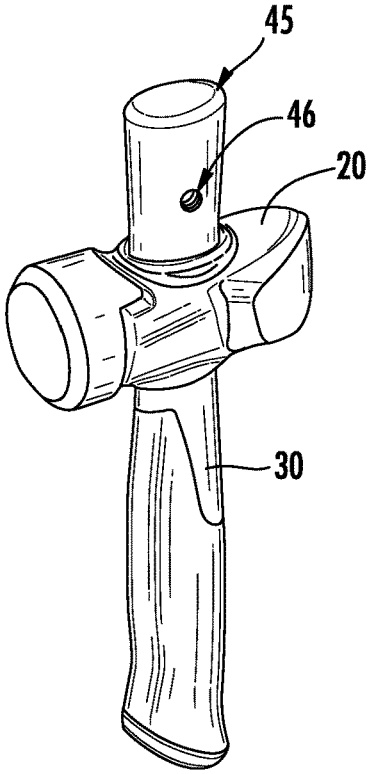
FIG. 9 is a schematic image of FIG. 8 with the sleeve assembly attached, according to an exemplary embodiment.

Fifth, the slide assembly (also referred to herein as the sleeve assembly) is attached to the first end 31 of the handle 30 over the collar 43 (see FIG. 9). The sleeve assembly (i.e., the first and second sleeves 44, 45) is in place when the hole 47 substantially aligns with the corresponding hole 37 through the handle core 33, such that the pin 46 may be inserted through each of the holes 37 and 47 (see, e.g., FIGS. 3-4). In this regard, the pin 46 securably holds the first sleeve 44 and second sleeve 45 to the collar 43 and core 33 of the handle 30. In one embodiment, the pin 46 is formed from hardened steel. In other embodiments, the pin 46 is formed from any material capable of securably holding the sleeve assembly to the handle 30. As shown in FIGS. 3-4, the hole 47 goes through the sleeves 44, 45 and the collar 43. As depicted, the location of the hole 47 is relatively closer to the bottom end 42 than the top end 41 of the mechanism 40. However, in various other embodiments, the hole 47 location may be relatively closer to the top end 41, centrally located (based on the length from the top end 41 to the bottom end 42 of at least one of the collar 43 and the sleeves 44, 45), and/or in any other position desired.

Figure 10:
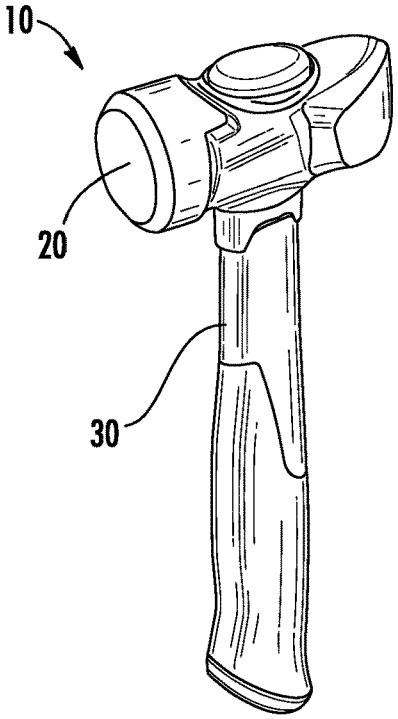
FIG. 10 is a top perspective view of an assembled hand operated striking tool via the graphical steps shown in FIGS. 5-9, according to an exemplary embodiment.

Sixth, after the mechanism 40 is secured to the handle 30, the tool head 20 is driven upward (toward the first end 31 of handle 30) and seated on the mechanism 40 (see FIG. 10). In this regard, FIG. 10 depicts the assembled tool 10 according to one embodiment. There are several features relevant to the tool head 20-to-mechanism 40 attachment, which are described below.

In the assembled position for the tool 10, according to the embodiment of FIGS. 1-4, an inner first circumferential shoulder 35 of the outer surface 34 abuts the collar 43 and the first sleeve 44 while an outer second circumferential shoulder 36 of the outer surface 34 abuts the second sleeve 45. As shown in FIG. 3, the outer second sleeve 45 is relatively longer than the collar 43 and the first sleeve 44, such that the second circumferential shoulder 36 is offset relative to the first circumferential shoulder 35. The length of the second sleeve 45 and offset direction is taken in from the first end 31 proximate to the second end 32 of the handle 30. Thus, the second sleeve 45 extends closer to the second end 32 than the first sleeve 44 and the collar 43. Similarly, the second circumferential shoulder 36 is relatively closer to the second end 32 than the first circumferential shoulder 35. It should be understood that this configuration is exemplary only. Other configurations may use no offset between the collar and sleeves, both (or as many sleeves included) may be offset (e.g., closer to or further form the first end 31) than the collar, and/or any other configuration desired.

Figure 11:
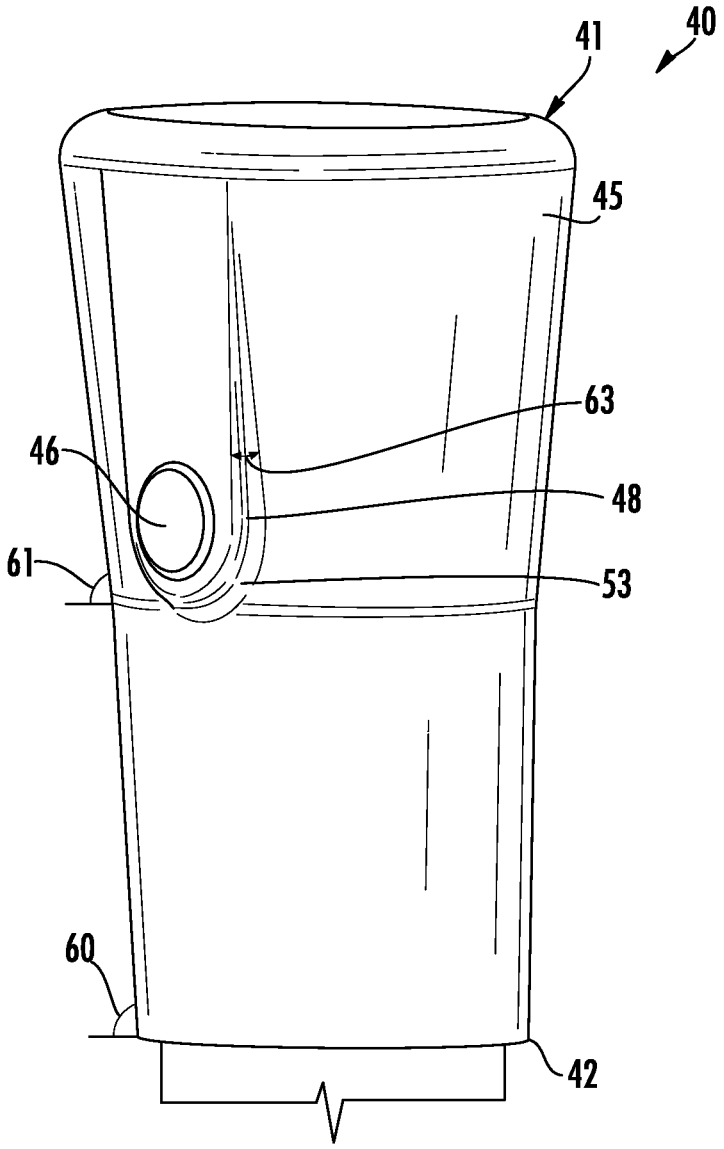
FIG. 11 is a close-up image of a vibration reduction mechanism attached to a handle of a hand operated striking tool, according to an exemplary embodiment.

As mentioned above, the outer second sleeve 45 may be tapered (see, e.g., FIG. 11) to match or substantially match the tapering of the hole 23 defined by the tool head 20 (see, e.g., FIG. 12). More particularly, an outer profile of the outer second sleeve 45 may be tapered. Referring back to FIG. 4, at or near the top end 41 of the sleeve assembly, furthest from the second end 32 of the handle 30, the diameter 49 (or, circumference) of the second sleeve 45 is relatively larger than the diameter 50 (or, circumference) near the bottom end 42 of the second sleeve 45. Accordingly, a cylindrically-shaped taper is provided by the second sleeve 45. More particularly, a frustoconical shaped taper is provided by at least the outer profile of second sleeve 45. With reference to FIG. 4 and in the embodiment depicted in FIG. 11, a lower portion of the outer second sleeve 45 corresponds with a first taper angle 60, which extends to at or near a shelf 48, where a second taper angle 61 for the outer sleeve is utilized for the remaining portion of the outer sleeve 45 (e.g., to the top end 41). In this embodiment, a two-degree taper is utilized beginning at the bottom end 42. In the example depicted, the first taper angle 60 is a two-degree taper angle that stops at or near the shelf 48, where a five-degree second taper angle 61 of the outer sleeve 45 is employed and extends to at or near the top end 41. Thus, as shown in FIG. 11, a two-tiered tapering system is used with the second sleeve 45. In other embodiments, a single-tiered or a multi-tiered tapering system with other degrees (than the example described above) are utilized.

As briefly alluded to above and as shown in FIG. 11 and the cross-sectional view of FIG. 4, a shelf 48 for the pin 46 is provided in the outer sleeve 45. The shelf 48 is structured to at least partly support and shield the ends of the pin 46 protruding engaged with the outer sleeve 45. In some embodiments, the shelf 48 may also aid assembly with the tool head 20 by offering another structure for the tool head 20 to engage and couple with. In the example shown in FIG. 11, the shelf 48 is also tapered or angled relative to the outer sleeve 45 (e.g., protrudes out from). This is represented by shelf angle 63. In the example depicted, the shelf angle 63 corresponds with three-degrees, where the shelf 48, with the three-degree tapered area substantially extends to the top end 41. In the example depicted, the shelf 48 corresponds with a substantially tear-shaped structure. In other embodiments, any other shape may be used. In still other embodiments, the pin 46 may be shaped to match the contour or profile of the outer sleeve, such that pin 46-to-outer sleeve interface profile is substantially aligned and no shelf may be utilized. All such variations are intended to fall within the scope of the present disclosure.

Figure 12A:
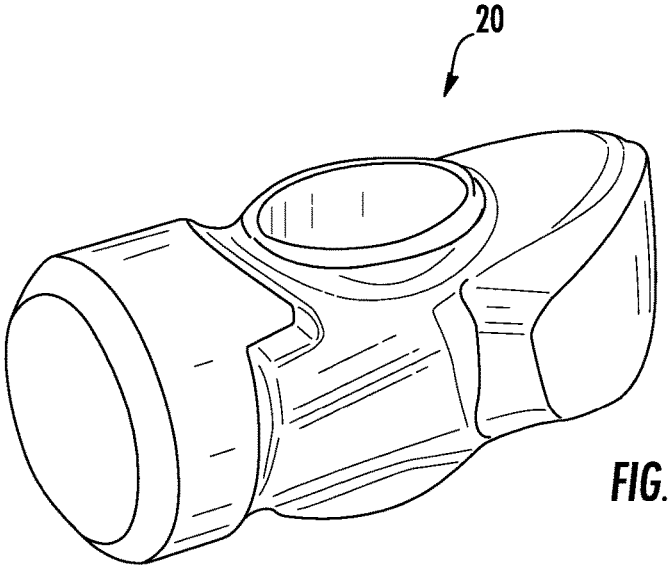
FIGS. 12A-12B are perspective (FIG. 12A) and cross-sectional (FIG. 12B) views of a tool head for a hand operated striking tool, according to an exemplary embodiment.
Figure 12B:
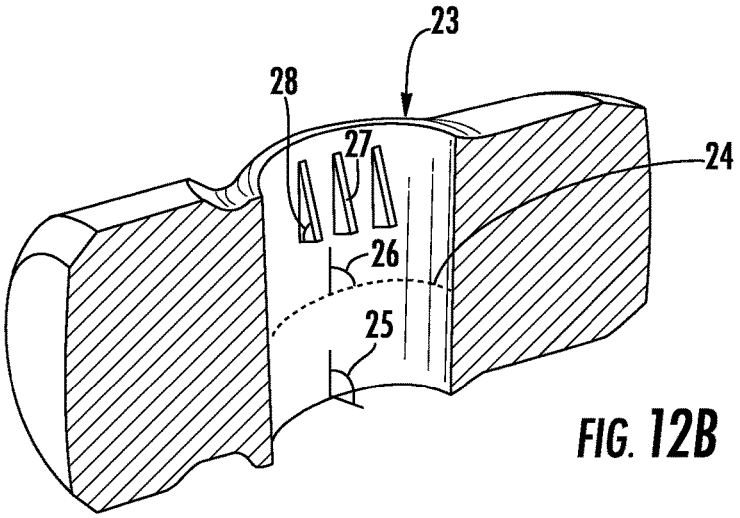
Figure 13:
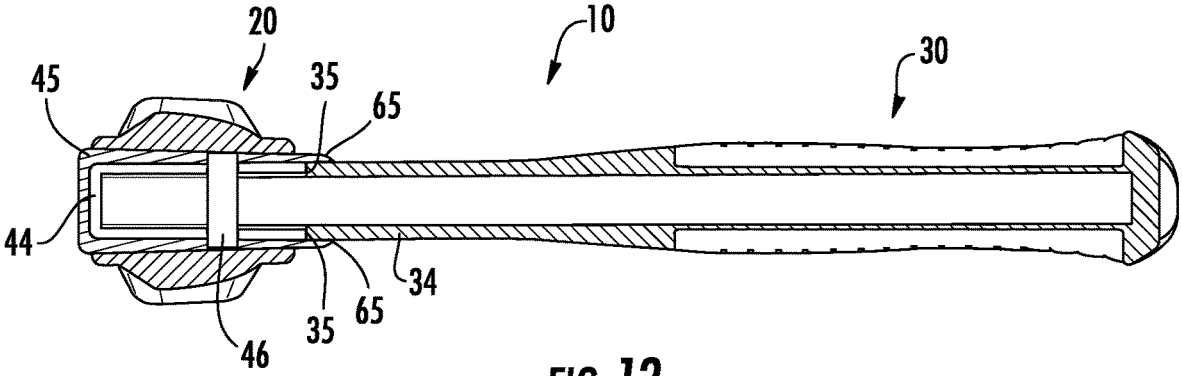
FIG. 13 is a side cross sectional image of a hand operated striking tool with a vibration reduction mechanism, according to an exemplary embodiment.

Referring now to FIGS. 12A-12B, a top perspective view (FIG. 12A) and a cross-sectional view (FIG. 12B) of the tool head 20 is shown, according to one embodiment. FIGS. 12A-12B may be used to depict and aid explanation of coupling the tool head 20 to the vibration reduction mechanism 40. FIG. 12B depicts the tool head 20 with a tapered hole 23. In one embodiment, the tapering of the hole 23 substantially matches that of the second sleeve 45. Accordingly, the hole 23 is tapered for an interference and retention fit with the mechanism 40. As shown in FIG. 12B, the inner surface of the tool head 20 that defines the hole 23 includes small vertical bands 27 (e.g., protrusions, etc.) in the upper area (above separation line 24) corresponding to the second taper angle 61 of the outer sleeve 45. In this regard, the separation line 24 between the upper area and lower area aligns with or substantially aligns with the taper area beginning at or near the shelf 48 of the mechanism 40. As such, the lower portion of the interior surface of the hole 23 below the line 24 may have a first taper angle 25, which corresponds with the first taper angle 60, while the upper portion of the interior surface of the hole 23 above the line 24 may have a second taper angle 26 that corresponds with the second taper angle 61 of the outer surface 45. In other embodiments, similar to the outer sleeve 45, a uniform taper angle may be used for the hole 23, more than two taper angles may be utilized, etc.

As shown in FIG. 12B, the small vertical bands 27 are offset relative to the upper interior surface of the hole 23 (e.g., above the line 24). Further, the vertical bands 27 extend only from the approximately line 24 toward the top of the hole 23. In other embodiments, the bands 27 may extend the length of the hole 23, only in the lower part of the hold (i.e., below the line 24), only in a middle part of the hole 23, be excluded from the hole 23, and/or some combination therewith. As mentioned above, the bands 27 are offset relative to the inner surface of the hole 23, which is shown as a band angle 28. In the example depicted, the band angle 28 corresponds with three degrees. As such, these bands 27 create small shelves at or near the intersection of the two differently tapered regions. These shelves provide solid or substantially solid stops for the pin 46 to substantially prevent the tool head 20 from rotating or moving about the core 33. As mentioned above, in various other embodiments, the tapering angles and amount of tapered regions may vary based on the application.

According to another embodiment, the hole 23 may be configured not as a through-hole like shown in the embodiments herein. For example, in another embodiment, the top of the tool head 20 may extend over the top portion of the hole 23 (i.e., proximate the top end 31). When the handle core 33 is inserted into the opening in the bottom of the hole then, the top cap portion may then function like a stop to prevent or substantially prevent the handle core 33 and/or vibration reduction mechanism 40 from extending above the tool head 20. In this configuration, other mechanisms may be used to prevent or substantially prevent vertical relative motion between the vibration reduction mechanism 40 and the tool head 20.

Referring back to FIGS. 2-3, when the sleeve assembly is in the hole 23 of the tool head 20, the sleeve assembly is compressed radially (towards the core 33) to achieve an interference fit relationship between the second sleeve 45 and the tapered hole 23 of the tool head 20. In addition to the press-fit relationship, several other features also may be used to securably hold the tool head 20 to the mechanism 40. As mentioned above and with reference also to FIGS. 3-4 and 11, proximate the bottom end 42 of the mechanism 40, the shelf 48 may include a lower lip 53 formed in the second sleeve 45. The lip 53 partially surrounds the hole 47 and represents a transition to a relatively thinner outer second sleeve 45 (moving from the top end 41 to the bottom end 42 of the sleeve assembly). This transition represents the separation from the two different tapers used with the outer sleeve 45. The shelf 48 via at least the lip 53 is structured to substantially prevent the tool head 20 from moving in a direction towards the first end 31 of the handle 30. Additionally, as described above, the shelf 48 may interact with the vertical bands 27 to prevent or substantially prevent relative rotation between the tool head 20 and the vibration reduction mechanism 40.

Furthermore, as shown in FIG. 3, the assembly of the tool head 20 to the vibration reduction mechanism 40 includes additional vertical movement restraints (e.g. movement toward either end 31, 32). As shown, proximate the top end 41, a first circumferential ridge 52 of the second sleeve 45 overhangs a top edge 18 of the tool head 20 to substantially restrain the movement of the tool head 20 towards the first end 31. In addition, proximate the bottom end 42, a second circumferential ridge 51 is formed in the second sleeve 45. The second circumferential ridge 51 engages with a bottom edge 19 of the tool head 20 to substantially restrain movement of the tool head 20 towards the second end 32 of the handle 30. While the sleeve assembly is compressed radially to achieve the press-fit relationship, the areas of the sleeves not in contact with the surface defining the tool head 20 hole 23 may not be compressed. These non-compressed areas may substantially retain their original expanded shape and form the first and second circumferential ridges 52, 51. Thus, the press-fit engagement, the circumferential ridges 51, 52, as well as the shelf 48 and lip 53 may function to retain the tool head 20 to the mechanism 40 (both in a vertical fashion and a rotatable fashion).

Relative to the embodiment depicted in FIGS. 2-4, FIG. 10 depicts another embodiment of the relationship of the mechanism 40 with the tool 10. As described above, in regard to the embodiment of FIGS. 2-4, the outer second circumferential shoulder 36 of the outer surface 34 abuts the second sleeve 45. However, in the embodiment of FIGS. 5-13 (shown most clearly in FIG. 10), there is no outer second circumferential shoulder 36. Although the collar 43 and inner sleeve 44 abut the inner first circumferential shoulder 35, a portion 65 of the outer second sleeve 45 overhangs (e.g., drapes over, extends over, etc.) the outer surface 34 of the handle 30 (see, e.g., FIG. 13). By overhanging, any movement of the mechanism 40, particularly the sleeve assembly that occurs during the tool assembly process will result in predominately invisible misalignments. Beneficially, this results in a relatively more visually appealing tool.

Therefore, to summarize the exemplary embodiment, the tapered interference fit between the tool head 20 and the mechanism 40 (particularly, the outer sleeve 45) substantially prevents the tool head 20 from moving vertically (i.e., towards the top end 41 of the mechanism 40). Further, the vertical bands 27 may be used to substantially prevent relative rotational movement between the tool head 20 and the vibration reduction mechanism 40. The pin 46 is substantially only in physical contact with the inner surface of the tool head 20 when an upward force is applied that overcomes the frictional retention force (i.e., a substantial upward force may slightly move the tool head 20 toward the top end 41). In that case, the pin 46 substantially stops the movement of the tool head 20 by transmitting the force to the collar 43, which is rigidly connected to the core 33. As a by-product of the present disclosure, the pin-core force transmission functions as a secondary mode of retention should the collar-core bond fail. This is accomplished in either the embodiment depicted in FIGS. 5-13 (the overhanging second sleeve 45) or in FIGS. 1-4 (the second sleeve 45 abutting the outer surface 34).

With the structure and assembly in mind, an example operation of the vibrational reduction mechanism may be as follows. In this example, the tool 10 is structured as a sledgehammer, like shown in FIGS. 1-13, and the work piece is an object that a user of the tool 10 is preparing to impact. The user grasps a portion of the handle 30 at or near the second end 32 in one (or both) of their hands—likely their dominant hand. The tool 10 is brought back relative to the work piece to increase a distance between the tool 10 and the work piece. At this point, the user is increasing their potential energy to increase the force delivered to the work piece. The user then rapidly moves their arm holding the tool 10 toward the work piece in a swinging manner. The impact end 21—hammer portion—of the tool 10 strikes the work piece. Due to the collision from the strike, vibrations of varying frequencies are sent from the impact end 21 to the tool head 20. The outer second sleeve 45 may absorb the higher frequency vibrations to reduce transmission of the higher frequency vibrations to the handle 30. The inner first sleeve 44 may absorb the lower frequency vibrations to reduce transmission of the lower frequency vibrations to the handle 30. Because the mechanism 40 itself is separate and distinct from the tool head 20 and handle 30, the mechanism 40 may isolate other frequencies (in between the absorbed high and low frequency spectrums) to further reduce vibrations transmitted to the user via the handle 30. Accordingly, the user may operate the tool 10 for longer periods of time by experiencing a relatively lesser amount of painful or unpleasantness that may otherwise be experienced from each strike.

Referring now collectively to FIGS. 14-24, the hand operating striking tool 10, shown as a sledgehammer, is depicted according to another embodiment. Relative to embodiments depicted in FIGS. 1-13, the embodiment of FIGS. 14-24 corresponds with a particular vibration reduction mechanism 40 construction. For ease of explanation, similar reference numerals are used to depict the same or substantially same components as that explained herein above in regard to FIGS. 1-13.

Figure 14:
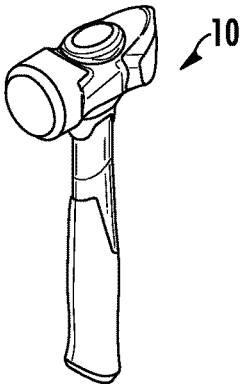
FIG. 14 is a schematic image of a top, front, and right perspective view of a hand operated striking tool, according to an exemplary embodiment.
Figure 15:
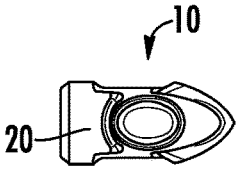
FIG. 15 is a top view of the tool of FIG. 14.
Figure 16:
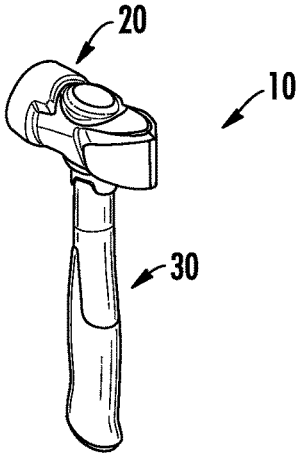
FIG. 16 is a back and top perspective view of the tool of FIG. 14.
Figure 17:
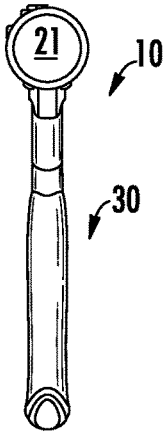
FIG. 17 is a front view of the tool of FIG. 14.
Figure 18:
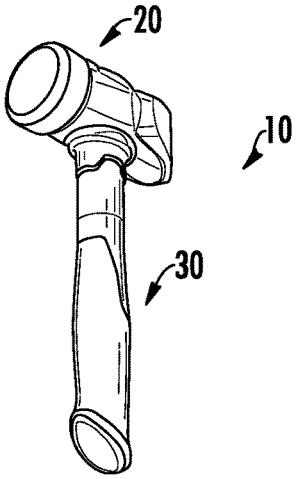
FIG. 18 is a top, front, and left perspective view of the tool of FIG. 14.
Figure 19:
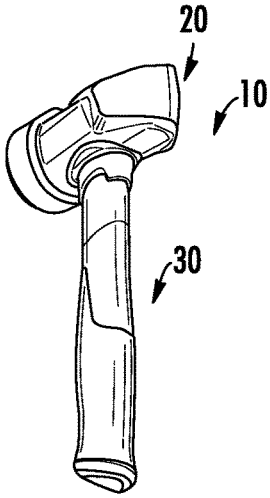
FIG. 19 is a bottom perspective view of the tool of FIG. 14.
Figure 20:
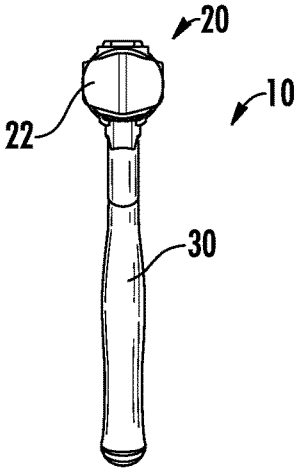
FIG. 20 is a back side view of the tool of FIG. 14.
Figure 21:
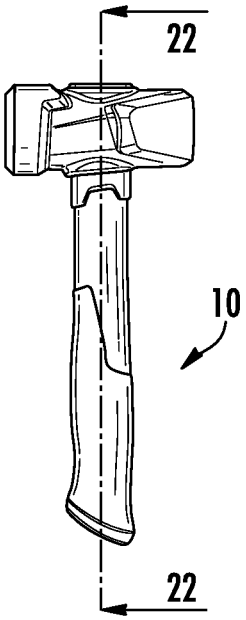
FIG. 21 is a side view of the tool of FIG. 14.
Figure 22:
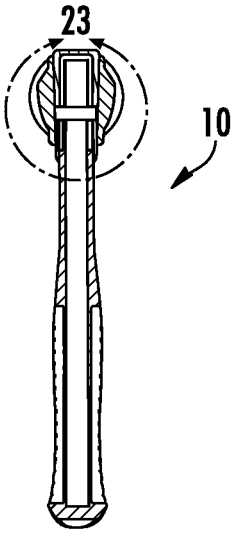
FIG. 22 is a cross-sectional view of the tool of FIG. 21 taken along line 22-22, according to an exemplary embodiment.

As shown, FIG. 14 depicts a top, front, right, perspective view of the tool 10; FIG. 15 depicts a top view of the tool 10; FIG. 16 depicts a back, top, perspective view of the tool 10; FIG. 17 depicts a front view of the tool 10; FIG. 18 depicts a top, front, left, perspective view of the tool 10; FIG. 19 a bottom perspective view of the tool 10; and, FIG. 20 depicts a back end view showing the back end 22 of the tool head 20 of the tool 10. In this regard, FIGS. 14-20 show various perspective, front, top, and back views of the tool 10. FIG. 21 shows a side view of the tool 10, according to one embodiment. FIG. 22 depicts the cross-sectional view taken along line 22-22 in FIG. 21, according to one embodiment.

Figure 23:
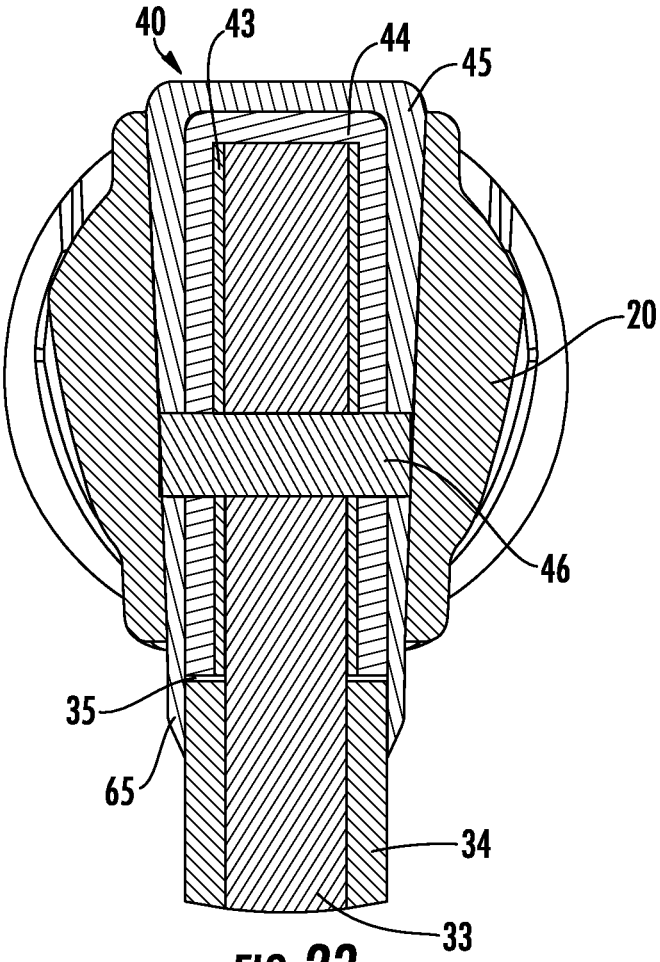
FIG. 23 is a close-up view of the section 23 in FIG. 22.

FIG. 23 depicts a close-up view of the tool head 20 and vibration reduction mechanism section 40 shown in in FIG. 22 in section 23. In this configuration, the shelf 48 of FIGS. 1-13 is excluded in the embodiment of FIGS. 14-24. However, similar to the embodiments of FIGS. 1-3, the tool 10 is shown to include a handle 30 having a core 33 surrounding by an outer surface 34. The core 33 may be constructed from any type of suitable handle core material. The outer surface 34 may have any type of structure used with handles and include one or more grip areas for the user. In one embodiment, the core 33 and outer surface 34 may be bonded together in a mold. In another embodiment, the core 33 and outer surface 34 may be combined in any suitable manufacturing/assembly process. The vibration reduction mechanism 40 is attached to a top portion of the handle core 33. As shown, the vibration reduction mechanism 40 also includes a collar 43 surrounded by a first sleeve 44, which is surrounded by a second sleeve 45. A pin 46 (e.g., locking device, retaining mechanism, etc.) is inserted at least partly through each of the second sleeve 45, first sleeve 44, collar 43, and core 33. As in the embodiment of FIGS. 5-13, a portion 65 of the second sleeve 45 over hangs a part of the outer surface area 34 (i.e., the portion 64 extends past a shoulder 35 interface of the outer surface 34 to both the first sleeve 44 and collar 43). A mold may be used to bond the first and second sleeves 44, 45 together while another mold is used to bond the outer surface area 34 to the handle core 33. Relative to the other embodiments, in this configuration, the construction of some of the components of the tool 10 may be described as follows: the outer surface area 34 is formed from an approximately twenty-percent glass fill (e.g., +/−five percent or other tolerance associated typically given by those of ordinary skill in the art); the pin 46 is formed from steel (or, some type of steel alloy); the handle core 33 is formed from pulltruded fiberglass; the collar 43 is formed from steel (or, some type of steel alloy); the inner first sleeve 44 has a durometer of approximately 50 Shore A (where approximately in regard to the durometer level corresponds with a tolerance given by those of ordinary skill in the art in regard to prescribing durometer levels); and, the outer second sleeve 45 has a durometer of 90 Shore A. Nonetheless, like the other embodiments, this material construction is illustrative only as many other types and characteristics of those types may be used for one or more of the components of the tool 10.

Figure 24:
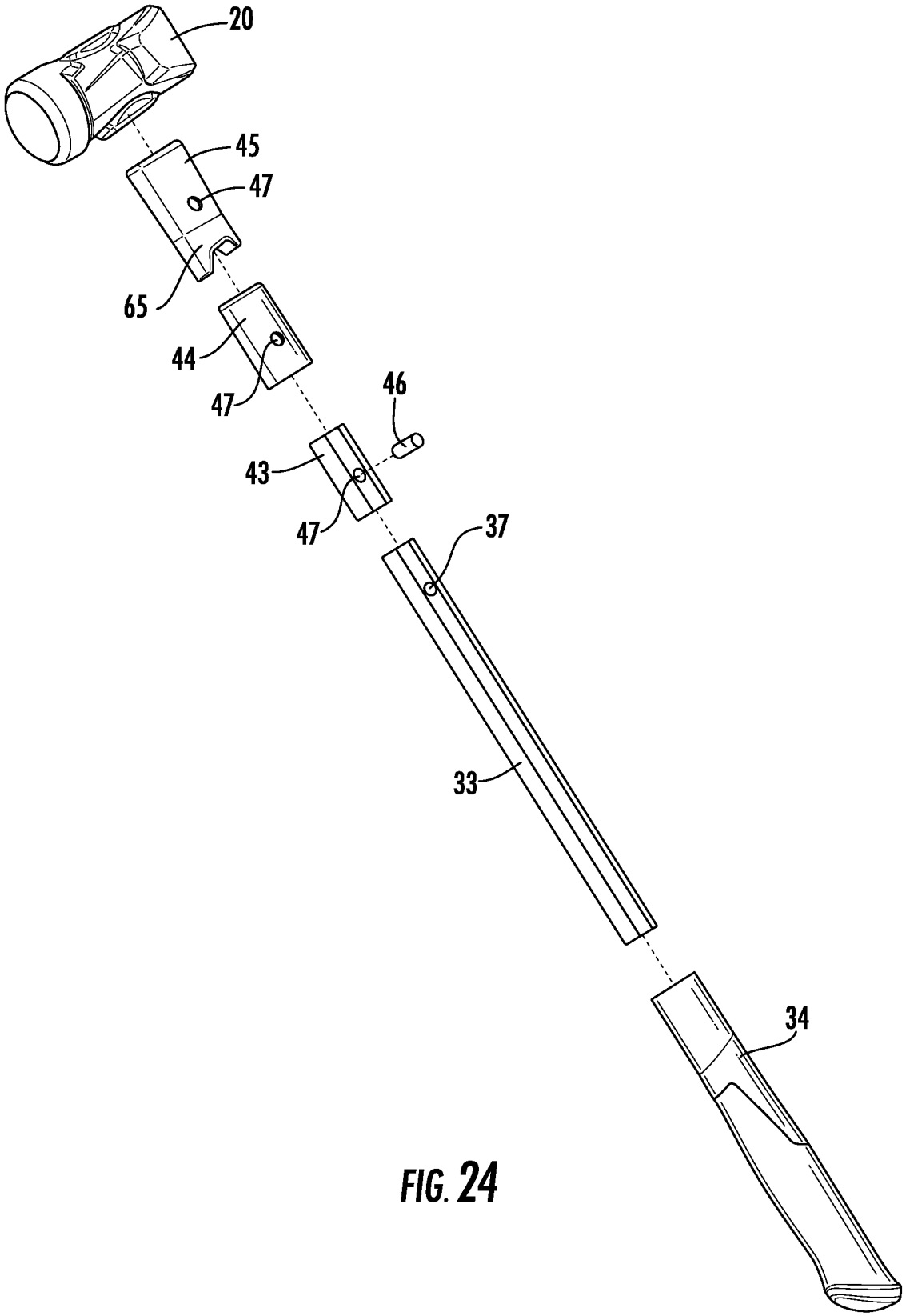
FIG. 24 is an exploded assembly view of the tool of FIGS. 14-23, according to an exemplary embodiment.

Referring now to FIG. 24, an exploded assembly view of the components of the tool 10 of FIGS. 14-24 is shown, according to one embodiment. The extending portion 65 of the outer sleeve 45 may be seen relatively clearly in FIG. 24 relative to the other components of the tool 10.

Figure 25:
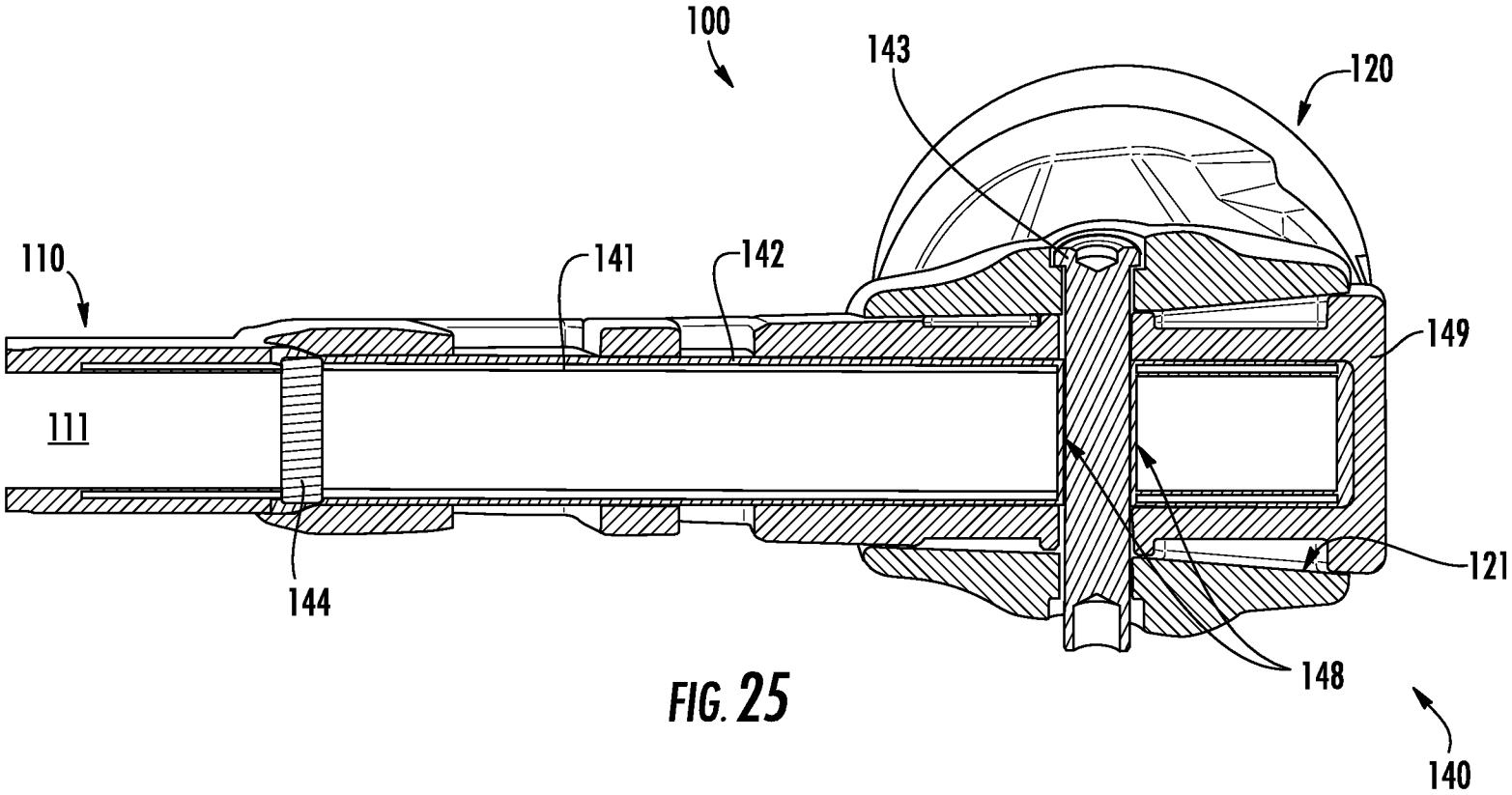
FIG. 25 is a back cross-sectional view of a long-handle hand operated striking tool with a vibration reduction mechanism, according to an exemplary embodiment.

Referring now to FIG. 25, a backside cross-sectional view of a long-handle hand operated striking tool 100 (the "tool") with a vibration reduction mechanism is shown, according to another embodiment. The tool 100 may be structured as any type of striking tool including, but not limited to, a hammer, an axe, a pick-axe, variations thereof, and the like. In the example depicted in FIG. 25 (and in FIGS. 26-33), the tool 100 is configured as a long-handle hand operated striking tool. The phrase "long-handle" is intended to be broadly interpreted to refer to and cover hand operated striking tools with a relatively long handle as interpreted by those of ordinary skill in the art. In one embodiment, the term "long handle" refers to hand operated striking tool with a handle length greater than or equal to approximately twelve (12) inches, where approximately refers to a tolerance amount provided by those of ordinary skill in the art (e.g., +/−0.5 inch, etc.).

As shown, the tool 100 includes a tool head 120, a handle 110 having a handle core 111, and a vibration reduction mechanism 140 disposed as an intermediary between the tool head 120 and the handle 110. Similar to the tool 10 of FIGS. 1-24, the tool head 120 may have any type of configuration depending on the intended use of the tool 100 (e.g., a hammer head, a pick head, an axe head, etc.). Accordingly, the tool head 120 may be constructed from any suitable material for the tool, such as metal, metal-based alloys, wood, rubber (e.g., a rubber mallet), etc. Relative to FIGS. 1-24, in the embodiment of FIG. 25 and FIGS. 26-33, the tool head 120 may also define a hole 121, but the hole 121 may be of a consistent opening width. In this embodiment, the hole 121 may be non-tapered and have any shape to match or substantially match the vibration reduction mechanism 140.

The vibration reduction mechanism 140 is disposed between the handle 110 and the tool head 120. Accordingly, the vibration reduction mechanism 140 decouples the handle 110 from the tool head 120. As such, impact vibrations received from use of the tool 100 may be dissipated prior to transmission to the handle 110 and, eventually, the user. The vibration reduction mechanism 140 is shown to include a collar 141 coupled to and proximate the handle core 111, a first sleeve 142 interposed over the collar 141, and a second sleeve 149 interposed over the first sleeve 142.

The collar 141 surrounds or substantially surrounds the handle core 111. As shown, the collar 141 is disposed on a first end portion of the handle core 111 proximate the tool head 120 (as compared to the second portion of the handle core 111, which refers to the user interface portion). In one embodiment and as shown in FIGS. 25-33, the collar 141 has a tube configuration, where each end of the tube is open. In other embodiments, an end of the collar 141 may be closed such that the collar 141 covers an end surface of the core 111 in addition to at least a portion of the sides of the core 111. Relative to FIGS. 1-24, as shown in FIG. 25, the collar 141 extends from at or near an upper or top end of the handle core 111 a relatively further length than the collar 43. More particularly, as shown in FIG. 25, the collar 141 extends past a length of the sleeves 142, 149 toward the second end portion of the handle core 111. In this regard, and in one instance, the collar 141 overlaps with the over mold 112. The precise amount of overlap may vary from application-to-application. In one embodiment, the collar 141 is constructed from a metal-based material, such as steel. In another embodiment, the collar 141 is constructed from any substantially hard material (e.g., a hard plastic, etc.). By increasing the length of the collar 141, the collar 141 may provide overstrike protection for the core 111 for added durability.

In operation, the core 111 may be vulnerable for a short distance below the head 120 where the energy from an overstrike may cause focused bending. As briefly described above, according to the present disclosure and as shown in FIG. 25, the collar 141 may extend just far enough to bridge the gap from the vibration reduction mechanism 140 to the over mold 112. While this extension amount may be variable from application-to-application, Applicants have determined that using a functional test—known as the tensile test—the combination of the collar 141 and lower placed pin 144 (due to the collar extending a relatively further distance) may increase the holding power of the tool head 120. In the tensile test, the handle is secured vertically and the head is pulled upwards. Existing standards set limits for this, and in some cases, the limit is approximately 4,000 pounds (however, in other cases, a different limit may be employed). By extending the collar 141 downward further to bridge the gap, the pin 144 may be placed relatively lower on the handle 110 (e.g., further from the tool head 120) such that it is unlikely for the tool head 120 to pull out from the top. Moreover, the collar 141 aids in resisting shear forces because without it, the core 111 may split into two halves at or near the pin location. Due to the combination of the collar 141 and the pin 144 placed relatively low on the core 111 relative to the head 120, Applicants have determined that the hand operated striking tool of the present disclosure may exceed the tensile test requirements. As such, extending the collar 141 a relatively further distance relative to the head 120 may beneficially work to substantially secure the tool head 120. It should be understood that other tests with other advantages and benefits may also be applicable to the vibration reduction mechanism of the present disclosure.

The first sleeve 142 is interposed over a part of the collar 141. Further, the first sleeve 142 is shown to extend over a top or upper end of the handle core 111. In the embodiment depicted, the first sleeve 142 is of a substantially uniform thickness across the length of the first sleeve 142. In other embodiments, the thickness of the first sleeve 142 may be variable.

The second sleeve 149 is interposed over or at least partly over the first sleeve 142. As shown, the second sleeve 149 has a relatively greater thickness than the first sleeve 142. Further, the first and second sleeves 142 and 149 are shown to extend to a substantially similar distance along the handle 110 (e.g., toward the second end portion from the first end portion proximate the tool head 120). However, in other embodiments, the first and second sleeves 142, 149 may be of the same or similar thickness and/or extend different lengths toward the second end portion of the handle 110. All such variations are intended to fall within the spirit and scope of the present disclosure.

In one embodiment, the first and second sleeves 142, 149 are constructed from the same or similar materials as the sleeves in the sleeve assembly of FIGS. 1-24. Accordingly, the outer second sleeve 149 may absorb, isolate, and/or dampen a first vibrational frequency while the inner first sleeve 142 may absorb, isolate, and/or dampen a second vibrational frequency, where the first and second vibrational frequencies are different due to the different characteristics of each of the first and second sleeves 142, 149 (e.g., the first sleeve may correspond with a resilient material having a Shore A durometer value between 0 and 60 while the second sleeve may also correspond with a resilient and durable material but has a Shore A durometer value between 60 and 100). It should be understood that in other embodiments, other durometer or other differentiating characteristics may be used to define each of the first and second sleeves 142, 149. In still other embodiments, more than two sleeves may be used, only one sleeve used, etc. Accordingly, the two sleeve configuration of the vibration reduction mechanism 140 is not meant to be limiting.

The vibration reduction mechanism 140 is shown to also include a pin 144 (e.g., locking device, coupling apparatus, etc.). As shown, the pin 144 is positioned on the first end portion of the tool 100 (i.e., proximate the tool head 120) substantially at or near an approximate end point for each of the first and second sleeves 142 and 149 proximate the second end portion of the handle core 111. The pin 144 extends through the handle core 111 and opposite sides of the collar 141 to retain the collar 141 on the handle core 111. The pin 144 may be constructed from any suitable material including, but not limited, a metal-based material such as steel. The pin 144 may further have any shape desired to engage the handle core 133 and collar 141.

Moreover, the pin 144 may allow rotation of the tool head 120 about the hole that receives the pin 144. Accordingly, when the strike of the tool 100 is even slightly off center vertically, the head 120 may rotate about the hole and compress the sleeves of the vibration reduction mechanism 140. Advantageously, this structure may allow for another mode of vibration reduction.

The vibration reduction mechanism 140 further includes a retainer 143 positioned above (e.g., relatively closer to an upper end of the handle core 111) than the pin 144. The retainer 143 may be configured as any type of holding device, such as a pin. In the embodiment shown, the retainer 143 is configured as a rivet, and more particularly, a tubular rivet. The rivet extends at least partly through each of the tool head 120, outer sleeve 149, inner sleeve 142, collar 141, and handle core 111. By extending through each of the aforementioned components, the retainer 143 increases the holding force of the tool head 120, which may be beneficial in the long-handle embodiment due to the relatively greater forces experienced from use of the tool 100 (due to a relatively longer moment arm with the long-handle embodiment over relatively shorter length handles). In turn, a relatively greater durability may be experienced with the tool 100. Further, by passing through the tool head 120, the rivet or retainer 144 may be rigidly coupled to the tool head 120 (however, as described below, the gap 148 may function to decouple the tool head 120 from the handle 110 to substantially prevent vibration transmission from the tool head 120 to the handle 110).

While the rivet or retainer 144 is shown to extend through each of the tool head 120, second sleeve 149, first sleeve 142, collar 141, and handle core 111, the rivet is separated by a gap 148 (e.g., clearance volume) between the rivet and the handle core 111. As also shown, the gap 148 is in communication with the collar 141. In this regard, the tool head 120 remains decoupled from the handle core 111 to substantially prevent the direct transmission of impact forces from the tool head 120 to the handle 110. In one embodiment, the gap 148 may be an air gap. However, in the embodiment depicted, the gap 148 is filled or substantially filled by the first sleeve 142 material. In this regard, the first sleeve 142 insulates the rivet or retainer from transmitting or substantially transmitting vibrations to the handle core 111.

Figure 26:
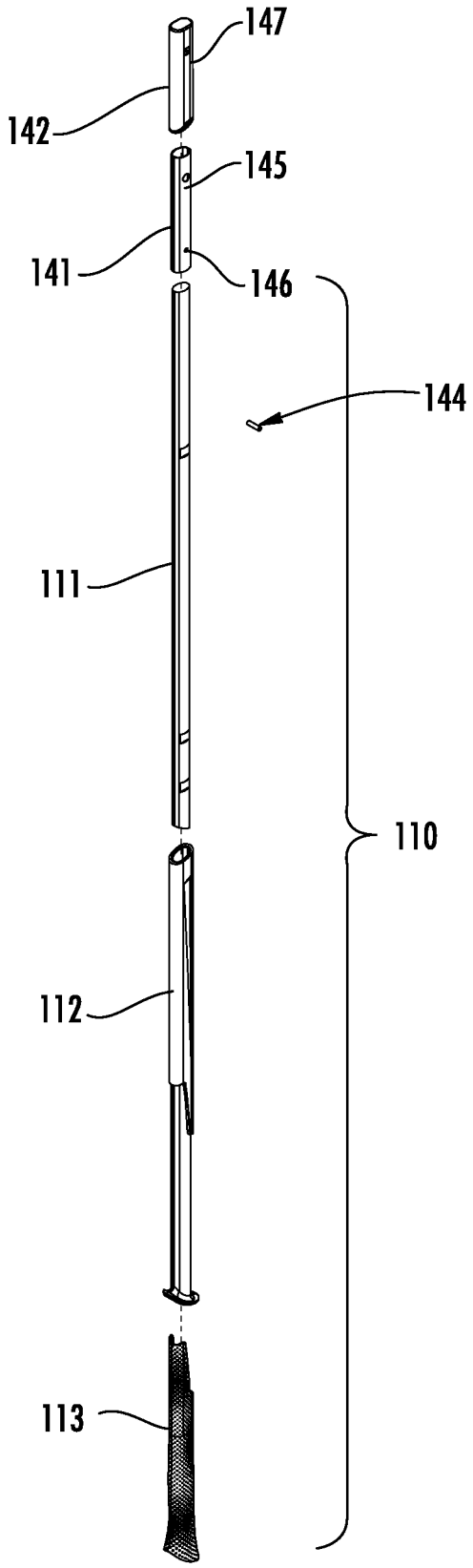
FIG. 26 is an exploded assembly view of the tool of FIG. 25, according to an exemplary embodiment.

With the above in mind, an example assembly process for part of the tool 100 is shown in FIGS. 26-33, with FIG. 26 depicting an exploded assembly diagram of the long-handed tool 100, according to one embodiment. As shown, the tool 100 is depicted without the tool head 120, where the tool 100 includes the handle 110 comprising the handle core 111, a handle over mold 112, and a grip substrate 113. Assembly of the handle 110 including the vibration reduction mechanism 140 is showing graphically in regard to FIGS. 27-33 and described as follows.

Figure 27:
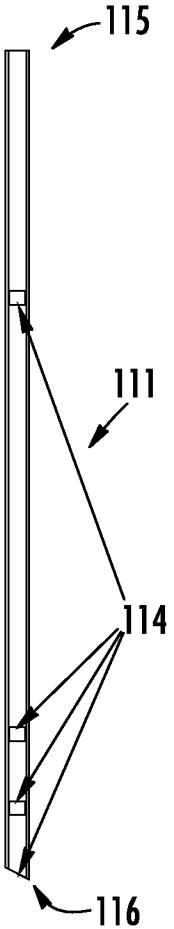
FIG. 27 is a schematic image of a handle core for the hand operated striking tool of FIG. 26, according to an exemplary embodiment.

First, the handle core 111 is prepared (FIG. 27). Preparation of the handle core 111 may include the construction of one or more recesses 114 (e.g., voids, cavities, openings, etc.). The recesses 114 may facilitate the adhesion of the over mold 112 to the core 111 (e.g., via a corresponding tab in the over mold 112, a bonding agent location, etc.). As shown, in this example, a plurality of recesses 114 are provided in the second end portion 116 of the handle core 111 while a single recess 114 is provided in or near the first end portion 115 of the handle core 111. As described herein, the first end portion 115 of the handle core 111 receives the vibration reduction mechanism 140.

Figure 28:
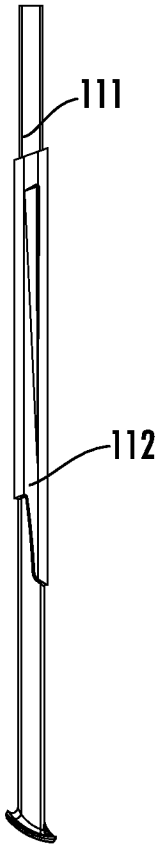
FIG. 28 is a schematic image of the handle core of FIG. 27 coupled to an over mold, according to an exemplary embodiment.

Second, the over mold 112 is attached to the handle core 111 (see FIG. 28). Attachment may be via any attachment process including, as described above, the use of a bonding agent, a tab on the over mold 112 that is received by one or more of the recesses 114, etc. The over mold 112 may be constructed from any type of material including, but not limited to, rubber, polymer, etc.

Figure 29:
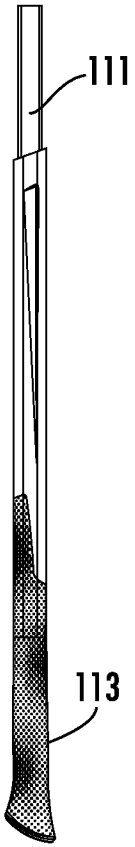
FIG. 29 is a schematic image of the handle core and over mold assembly of FIG. 28 further coupled to a grip substrate, according to an exemplary embodiment.

Third, the grip 113 is attached to the over mold 112 (see FIG. 29). In this example, the grip 113 is attached in or substantially in a cavity of the over mold 112. When using the tool 100, a user may hold the grip 113 to operate the tool. In other embodiments, a user may hold at least a portion of the over mold 112, grip 113, and/or a combination of both components when operating the tool 100. Attachment of the grip 113 to the over mold 112 may be via any attachment process including, but not limited to, via a bonding agent, one or more fasteners, an interference fit, etc.

Figure 30:
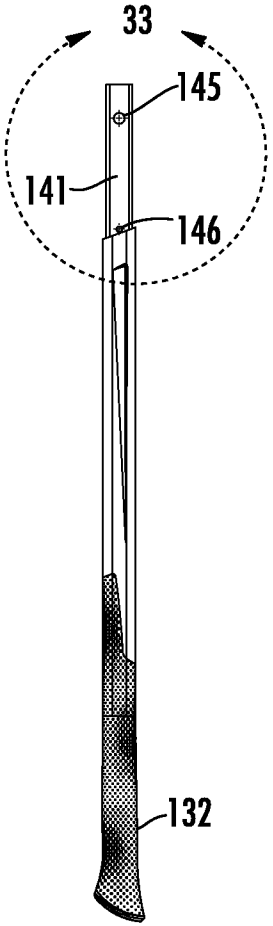
FIG. 30 is a schematic image of the handle assembly of FIG. 29 with a collar of the vibration reduction mechanism applied to the handle core, according to an exemplary embodiment.
Figure 33:
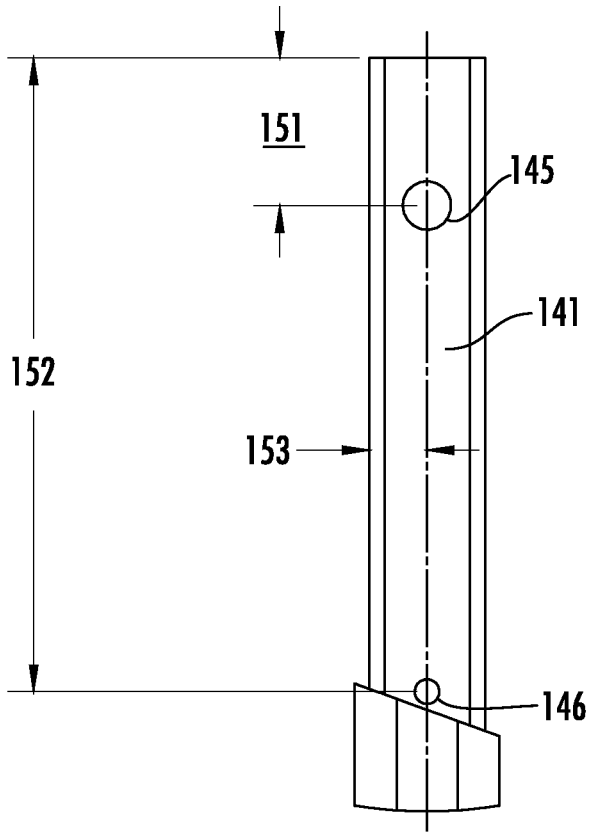
FIG. 33 is a close-up view of section 33 in FIG. 30.

Fourth, the collar 141 is applied on at least part of the first end portion 115 of the core 111 (see FIG. 30). Further, a first hole 145 and a second hole 146 are constructed in the collar 141 and core 111 assembly (see also FIG. 26). The first and second holes 145, 146 may be drilled, punched, etc. In some embodiments, the holes may be provided in each of the collar 141 and core 111 separately. All such variations are intended to fall within the scope of the present disclosure. Referring now to FIG. 33, a view of section 33 in FIG. 30 is shown, according to one embodiment. FIG. 33 depicts the relative locations and sizes of the first and second holes 145, 146, according to an example configuration. In this regard, in one embodiment, the first hole 145 is of a relatively larger diameter than the second hole 146. This configuration is depicted in FIG. 33 along with other dimensional characteristics. In this example, the first hole 145 corresponds with a diameter of 0.47 inches with a tolerance of +0.001 and −0.000 inches; the second hole 146 corresponds with a diameter of 0.24 inches with a tolerance of +0.001 and −0.000 inches; the first hole 145 is positioned a distance 151 (from a top end of the collar 141 to a center of the first hole 145) of 1.43 inches; the second hole 146 is positioned a distance 152 (from a top end of the collar 141 to a center of the first hole 145) of 6.16 inches; and, each of the first and second holes 145, 146 are positioned at 0.56 inches+/−0.003 inches from an edge of the collar 141 (e.g., inward). It should be understood that these dimensions are for illustrative purposes only and are not meant to be limiting, such that other embodiments may use different dimensional configurations and still fall within the spirit and scope of the present disclosure.

Figure 31:
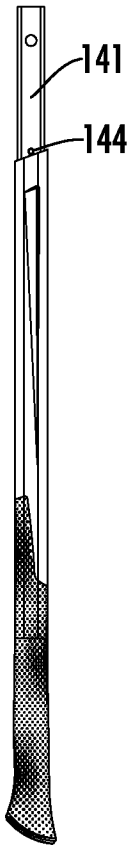
FIG. 31 is a schematic image of the assembly of FIG. 30 with a pin applied to the collar and handle core, according to an exemplary embodiment.

Fifth, the pin 144 is provided in the lower hole 146 to retain the collar 141 on the core 111 (see FIG. 31). Due to the combination of the pin 144 and retainer 143, the use of bonding agents and/or scoring/etching may be substantially avoided, which is in contrast to the scoring/etching and bonding agent(s) utilized in the embodiment of FIG. 5. However, in other embodiments, scoring, etching, and/or bonding agents may also be used in combination with the pin 144 and retainer 143.

Figure 32:
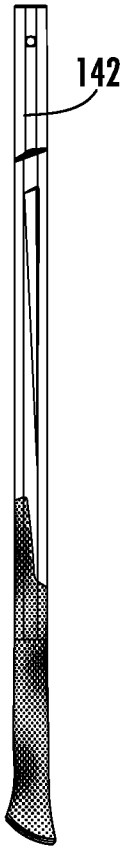
FIG. 32 is a schematic image of the assembly of FIG. 31 with a vibration isolator over mold applied to the collar, according to an exemplary embodiment.

Sixth, the sleeve assembly (or a part thereof) is provided at least partly over the collar (see FIG. 32). In one embodiment, the collar 141 and first sleeve 142 are bonded together in a mold (or in any fashion). Accordingly, at step six, the outer second sleeve 149 is applied to the collar 141 and first sleeve 142 assembly. In another embodiment, the first and second sleeves 142 and 149 are bonded together and then applied to the collar 141. In still another embodiment, the collar 141, first sleeve 142, and second sleeve 149 are bonded together (e.g., in a mold) and the bonded unit is applied to the handle core 111. Of course, in this instance (and/or others), one or more of the steps described above may be deleted and/or modified, with the possibility of other steps included. All such variations and combinations thereof are intended to fall within the scope of the present disclosure.

Figure 34:
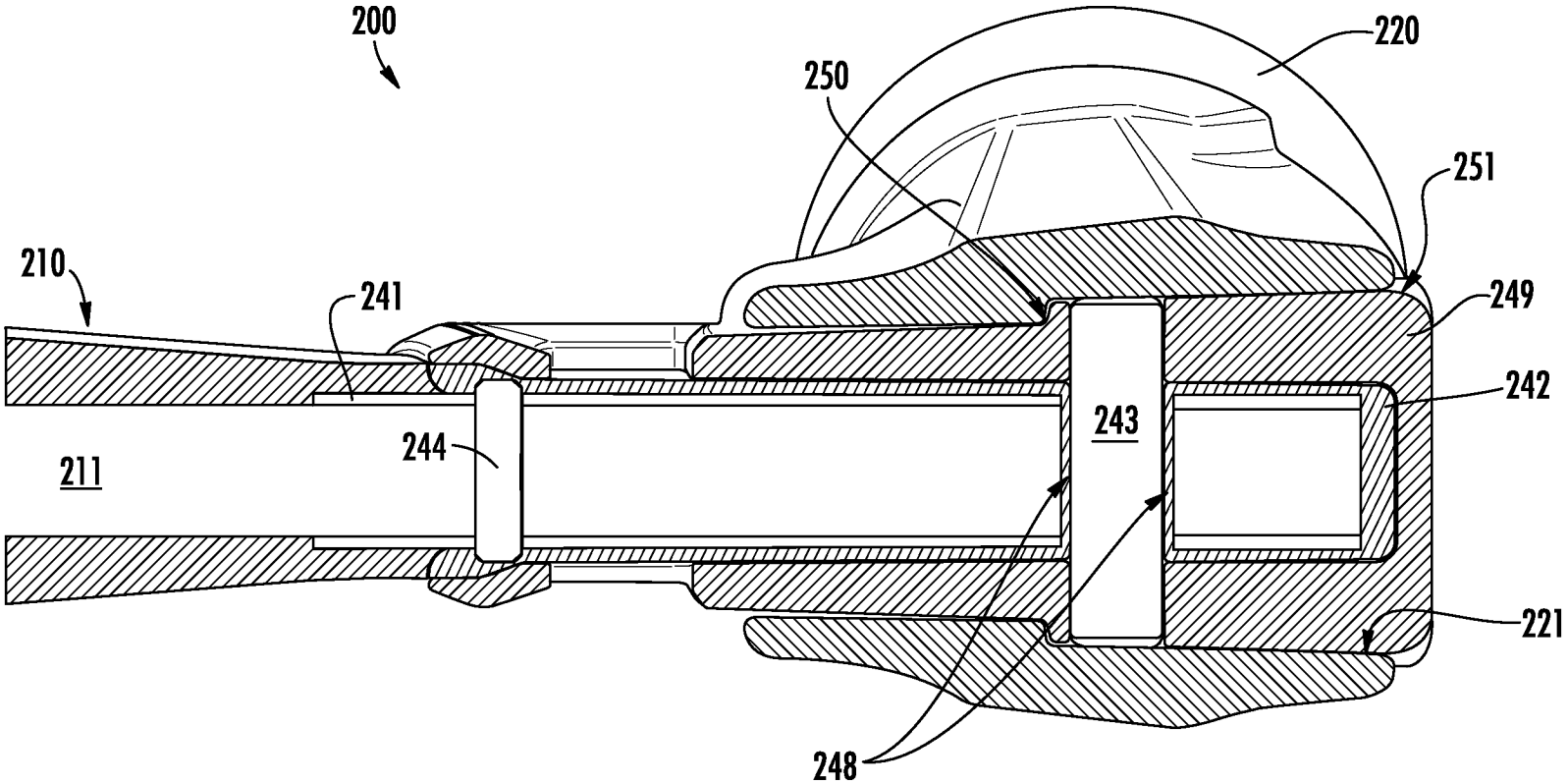
FIG. 34 is a back cross-sectional view of a short-handle hand operated striking tool with a vibration reduction mechanism, according to an exemplary embodiment.

Referring now to FIG. 34, a backside cross-sectional view of a short-handle hand operated striking tool 200 (the "tool") with a vibration reduction mechanism is shown, according to one embodiment. Relative to the tool 100, the tool 200 is configured as a short-handled hand operated striking tool. Like the tool 100, the short handle tool 200 may be structured as any type of striking tool including, but not limited to, a hammer, an axe, a pick-axe, variations thereof, and the like. However, the term "short-handle" is intended to designate that the tool 200 has a relatively shorter handle than the tool 100. Nonetheless, the term "short-handle" is intended to be broadly interpreted to refer to and cover hand operated striking tools with a short or relatively short handle as interpreted by those of ordinary skill in the art. In one embodiment, the term "short handle" refers to hand operated striking tool with a handle length less than or equal to approximately eleven (11) inches, where approximately refers to a tolerance amount provided by those of ordinary skill in the art (e.g., +/−0.5 inch, etc.). In other embodiments, the term "short-handle" refers to any handle length given by those of ordinary skill in the art for designating handle lengths corresponding to short-handle hand operated striking tools.

The tool 200 may have a similar structural configuration as the tool 100, but with a few differences described herein below. Generally speaking, the tool 200 includes a tool head 220, a handle 210 having a handle core 211, and a vibration reduction mechanism 240 disposed in between the handle core 211 and the tool head 220. In this regard, the vibration reduction mechanism 240 decouples the handle core 211 from the tool head 220.

Similar to the tool 10 of FIGS. 1-24 and the tool 100, the tool head 220 may have any type of configuration depending on the intended use of the tool 200 (e.g., a hammer head, a pick head, an axe head, etc.). Accordingly, the tool head 220 may be constructed from any suitable material for the tool, such as metal, metal-based alloys, rubber, wood, etc. The tool head 220 is shown to define a hole 221. The hole 221 may be tapered, like the hole 23 of FIGS. 1-24 and/or be of a constant or uniform opening width like the hole 121 of FIGS. 25-33. The vibration reduction mechanism 240 is shown to include a collar 241 coupled to the handle core 211, a first sleeve 242 interposed over the collar 241, and a second sleeve 249 interposed over the first sleeve 242.

The collar 241 surrounds or substantially surrounds the handle core 211. As shown, the collar 241 is disposed on a first end portion of the handle core 211 proximate the tool head 220. In one embodiment and as shown in FIGS. 34-42, the collar 241 has a tube configuration, where each end of the tube is open. In other embodiments, an end of the collar 241 may be closed such that the collar 241 covers an end surface of the core 211 in addition to at least a portion of the sides of the core 211. Relative to FIGS. 1-24 and similar to the embodiment depicted in FIGS. 25-33, the collar 241 extends from at or near an upper or top end of the handle core 211 a relatively further length than the collar 43. More particularly, as shown in FIG. 34, the collar 241 extends past a length of the sleeve assembly of the vibration reduction mechanism 240. In one instance, the collar 241 extends a length to allow an overlap of the collar 241 with the over mold 212. This length may be configurable to allow for a large and/or small overlap. In this regard, like the tool 100, a pin 244 may be placed relatively lower on the handle 210 to increase the tensile strength of the tool (in combination with the collar 241) to substantially prevent the tool head 220 from being pulled vertically from the core 211. According to an alternate embodiment, the collar 241 extends a preset length that may change from application to application. All such variations are intended to fall within the scope of the present disclosure. In one embodiment, the collar 241 is constructed from a metal-based material, such as steel or a metal-based alloy. In another embodiment, the collar 241 is constructed from any substantially hard material (e.g., a hard plastic, etc.). As mentioned above, by increasing the length of the collar 241, the collar 241 may provide overstrike protection for the core 211 for added durability.

The first sleeve 241 is interposed over at least a part of the collar 211. Further, the first sleeve 241 is shown to extend over a top or upper end of the handle core 211. In the embodiment depicted, the first sleeve 241 is of a substantially uniform thickness across its length. In other embodiments, the thickness of the first sleeve 241 may be variable.

The second sleeve 249 is interposed over the first sleeve 242. As shown, the second sleeve 149 has a relatively greater thickness than the first sleeve 242. Further, the first and second sleeves 242 and 249 are shown to extend to a substantially similar distance along a length of the handle 210 (e.g., toward the second end portion from the first end portion proximate the tool head 220). However, in other embodiments, the relative lengths of each of the first and second sleeves 242, 249 may differ from what is depicted (e.g., the first sleeve 242 is longer than the second sleeve 249, the second sleeve 249 is longer than the first sleeve 242, etc.). Furthermore, in still other embodiments, any number of sleeves may be used with the vibration reduction mechanism 240.

As shown, the second outer sleeve 249 has a taper beginning at a top end portion proximate the tool head 220 narrowing as the outer sleeve 249 extends towards the bottom end portion of the handle 210 (e.g., the user interface portion). Further, the outer profile of the outer sleeve 249 is shown to define a shoulder 250. In this embodiment, the shoulder 250 is proximate a first pin 243 (described below). The shoulder 250 interfaces with the tool head 220 to at least partly constrain the movement of the tool head 220 relative to the outer sleeve 249 and retain the tool head 220 on the outer sleeve 249.

In addition to the shoulder 250 to tool head 220 engagement, the tool head 220 may be retained via a variety of other mechanisms as well. A ridge 251 may be defined in the outer sleeve 249 proximate a top end of the tool head 220 that also engages with the tool head 220. Further, due to the tapering of the hole 221 and the outer sleeve 249, a wedge relationship may be formed between the outer sleeve 249 and the tool head 220. The wedge relationship may correspond with an interference fit to retain the tool head 220 on the outer sleeve 249. While some compression of the outer sleeve 249 may occur during assembly (e.g., to form the ridge 251), the first pin 243 is constructed from a substantially rigid material (e.g., metal based such as steel), such that the first pin 243 may maintain the wedge between the tool head 220 and the outer sleeve 249 to substantially securably hold the tool head 220.

Accordingly, the first and second sleeves 242, 249 may be constructed from the same or similar materials to that of the sleeves from FIGS. 26-33 and the sleeves from FIGS. 1-24. Accordingly, in one embodiment, each of the first and second sleeves 242, 249 may include characteristics to absorb, isolate, and/or dampen various frequency ranges. For example, the outer sleeve 249 may absorb a first frequency range while the first sleeve 242 may absorb a second frequency, where the first and second frequency ranges are different. In this regard, the first and second sleeves 242, 249 may have Shore A durometers like that of the other sleeves described herein above.

In the example depicted, the outer second sleeve 249 is constructed from the same or similar material as the outer mold 212 (see FIG. 35), where the outer mold 212 has a substantially rigid characteristic. In one embodiment, the material used for each of the outer second sleeve 249 and the over mold 212 is polypropylene with no glass fill (as compared to the glass fill used with the outer surface in the embodiment depicted in FIGS. 14-24). The substantially rigid characteristic may prevent deformation or substantial deformation caused by the wedge relationship. In turn, the wedge relationship may be maintained to increase the durability of the tool 200.

The vibration reduction mechanism 240 is also shown to include a first pin 243 and a second pin 244 (e.g., locking devices, retaining mechanisms, etc.). The pins 243, 244 may be constructed from a substantially rigid material, such as a metal-based material (e.g., steel). The second pin 244 is position relatively closer to a user interface portion on the handle 210 whereas the first pin 243 is positioned closer to a top end of the handle core 211. As shown, the pin 244 is positioned substantially at or near where the first sleeve 242 terminates (proximate the user interface portion). In other embodiments, the pin 244 may be positioned in any of a variety of other positions.

As shown, the second pin 244 extends through the handle core 211 and the collar 241. In one embodiment, the pin 244 also extends through the first sleeve 242. In another embodiment, the pin 244 does not extend through the first sleeve 242. In comparison, the first pin 243 is shown to extend through each of the handle core 211, collar 241, first sleeve 242, and second sleeve 249. In some instances, the pin 243 may be in contact with the tool head 220 (e.g., the surface defining the hole 221) to at least partly help maintain the wedge relationship.

While the pin 243 is shown to extend through each of the collar 241, first sleeve 242, second sleeve 249, and handle core 211, the pin 243 is separated by a gap 248 (e.g., clearance volume) between each of the handle core 211 and collar 241. In this regard, the tool head 220 remains decoupled from the handle core 211 to substantially prevent the direct transmission of impact forces from the tool head 220 to the handle 210. In one embodiment, the gap 248 may be an air gap. In the embodiment depicted, the gap 248 is filled or substantially filled by the first sleeve 242 material. While the gap 248 may decouple the tool head 220 from the handle core 211, the first pin 243 may engage with the tool head 220 to couple the tool head 220 to the first pin 243.

Similar to the tool 100, the second pin 244 of the tool 200 may allow rotation of the tool head 220 about the hole that receives the pin 2244. Accordingly, when the strike of the tool 200 is even slightly off center vertically, the head 220 may rotate about the hole and compress the sleeves of the vibration reduction mechanism 240. Advantageously, this structure may allow for another mode of vibration reduction.

Figure 35:
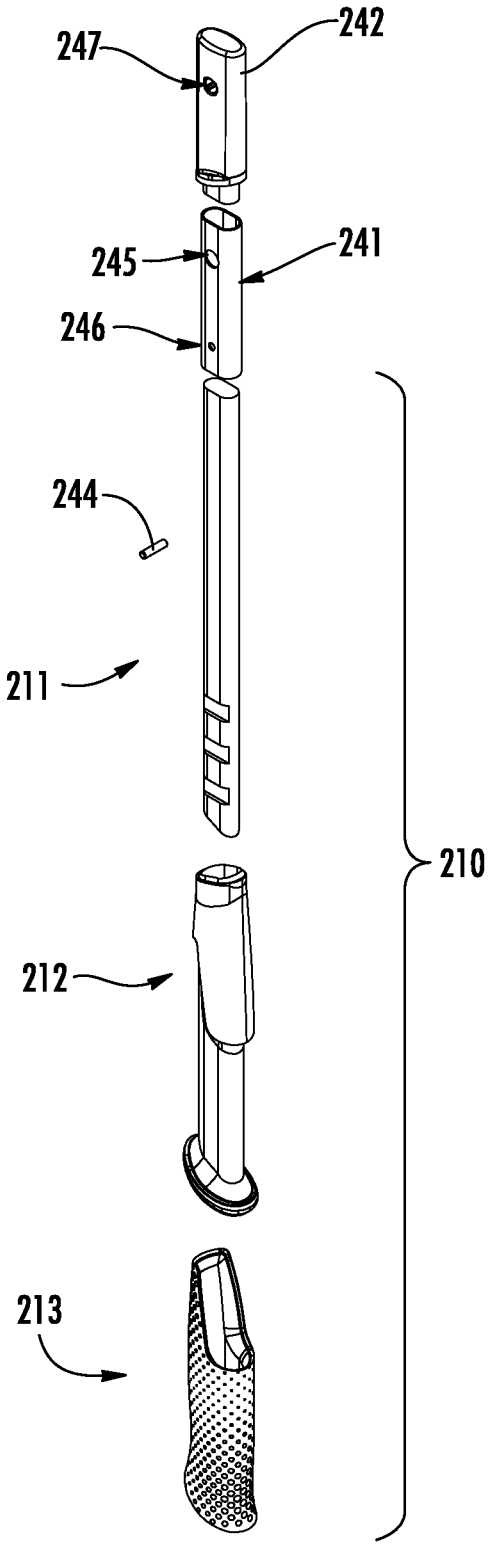
FIG. 35 is an exploded assembly view of the tool of FIG. 34, according to an exemplary embodiment.

With the above in mind, an example assembly process for part of the tool 200 is shown in FIGS. 35-42, with FIG. 35 depicting an exploded assembly diagram of the short-handed tool 200, according to one embodiment. As shown, the tool 200 is depicted without the tool head 220, where the tool 200 includes a handle portion 210 comprising the handle core 211, a handle over mold 212, and a grip substrate 213. Assembly of the handle 210 including the vibration reduction mechanism 240 is shown graphically in regard to FIGS. 36-42 and described as follows.

Figure 36:
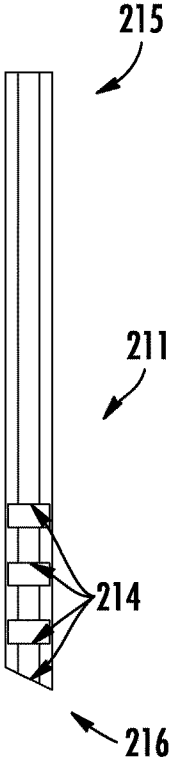
FIG. 36 is a schematic image of a handle core for the hand operated striking tool of FIG. 35, according to an exemplary embodiment.

First, the handle core 211 is prepared (FIG. 36). Preparation of the handle core 211 may include the construction of one or more recesses 214 (e.g., voids, cavities, openings, etc.). The recesses 214 may facilitate the adhesion of the over mold 212 to the core 211 (e.g., via a corresponding tab in the over mold 212, a bonding agent location, etc.). As shown, in this example, a plurality of recesses 214 are provided in the second end portion 216 of the handle core 211 while no recesses are provided in or near the first end portion 215 of the handle core 211. However, in other embodiments, no recesses 214 may be included with the core 211, a recess included in the first end portion 215 only, etc. As mentioned above, the first end portion 215 of the handle core 211 receives the vibration reduction mechanism 240.

Figure 37:
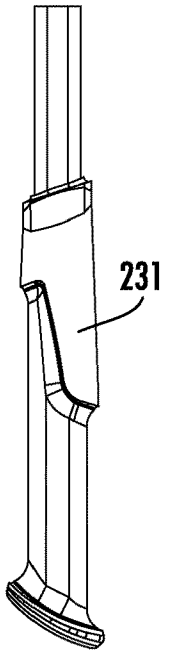
FIG. 37 is a schematic image of the handle core of FIG. 36 coupled to an over mold, according to an exemplary embodiment.

Second, the over mold 212 is attached to the handle core 211 (see FIG. 37). Attachment may be via any attachment process including, as described above, the use of a bonding agent, a tab on the over mold 212 that is received by the recess 214, etc. The over mold 212 may be constructed from any type of material including, but not limited to, rubber, polymer, etc.

Figure 38:
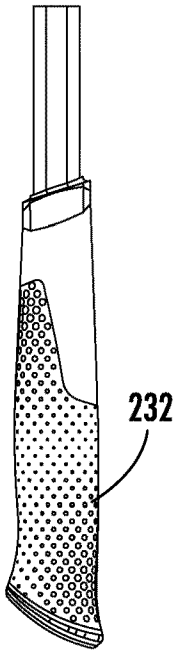
FIG. 38 is a schematic image of the handle core and over mold assembly of FIG. 37 further coupled to a grip substrate, according to an exemplary embodiment.

Third, the grip 213 is attached to the over mold 212 (see FIG. 38). In this example, the grip 213 is attached in or substantially in a cavity of the over mold 212. When using the tool 200, a user may hold the grip 213 area to operate the tool. In other embodiments, a user may hold at least a portion of the over mold 212, grip 213, and/or a combination of both components when operating the tool 200. Attachment of the grip 213 to the over mold 212 may be via any attachment process including, but not limited to, via a bonding agent, one or more fasteners, an interference fit, etc.

Figure 39:
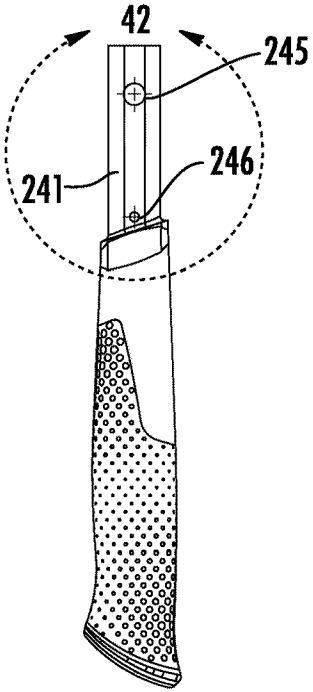
FIG. 39 is a schematic image of the handle assembly of FIG. 38 with a collar of the vibration reduction mechanism applied to the handle core, according to an exemplary embodiment.
Figure 42:
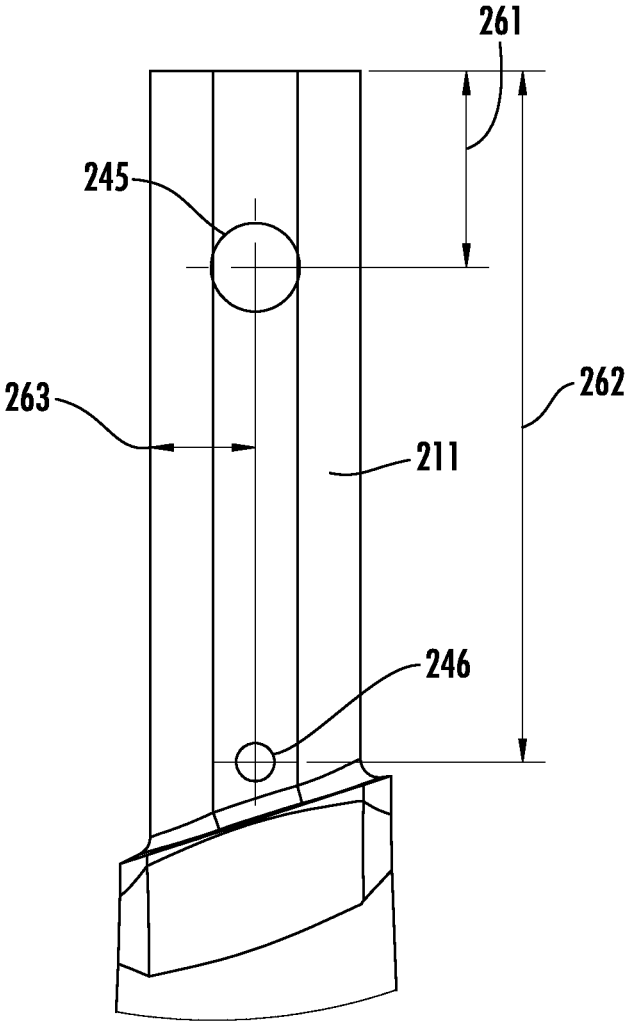
FIG. 42 is a close-up view of section 42 in FIG. 39.

Fourth, the collar 241 is applied on at least part of the first end portion 215 of the core 211 (see FIG. 39). Further, a first hole 245 and a second hole 246 are constructed in collar 241 and core 211 assembly. The first and second holes 245, 246 may be drilled, punched, etc. In some embodiments, the holes may be provided in each of the collar 241 and core 211 separately. All such variations are intended to fall within the scope of the present disclosure. Referring now to FIG. 42, a view of section 42 in FIG. 39 is shown, according to one embodiment. FIG. 42 depicts the relative locations and sizes of the first and second holes 245, 246, according to an example configuration. In this regard, in one embodiment, the first hole 245 is of a relatively larger diameter than the second hole 246. This configuration is depicted in FIG. 42 along with other dimensional characteristics. In this example, the first hole 245 corresponds with a diameter of 0.37 inches with a tolerance of +0.001 and −0.000 inches; the second hole 246 corresponds with a diameter of 0.16 inches with a tolerance of +0.003 and −0.002 inches; the first hole 245 is positioned a distance 261 (from a top end of the collar 241 to a center of the first hole 245) of 0.85 inches; the second hole 246 is positioned a distance 262 (from a top end of the collar 241 to a center of the first hole 245) of 2.91 inches; and, each of the first and second holes 245, 246 are positioned at 0.44 inches+/−0.003 inches from an edge of the collar 241 (e.g., inward). It should be understood that these dimensions are for illustrative purposes only and are not meant to be limiting, such that other embodiments may use different dimensional configurations and still fall within the spirit and scope of the present disclosure.

Figure 40:
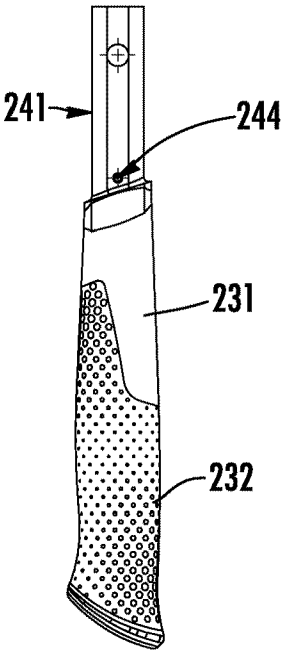
FIG. 40 is a schematic image of the assembly of FIG. 39 with a pin applied to the collar and handle core, according to an exemplary embodiment.

Fifth, the second pin 244 is provided in the lower hole 246 to retain the collar 241 on the core 211 (see FIG. 40). Due to the combination of the pins 243, 244, the use of bonding agents may be substantially avoided. Nonetheless, in some instances, scoring and the use of a bonding agent may be used in combination with the pins 243 and 244.

Figure 41:
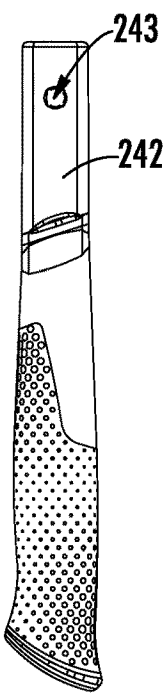
FIG. 41 is a schematic image of the assembly of FIG. 40 with a vibration isolator over mold applied to the collar, according to an exemplary embodiment.

Sixth, the sleeve assembly is provided at least partly over the collar (see FIG. 41). In one embodiment, the collar 241 and first sleeve 242 are bonded together in a mold (or in any fashion). Accordingly, at step six, the outer second sleeve 249 is applied to the collar 241 and first sleeve 242 assembly. In another embodiment, the first and second sleeves 242 and 249 are bonded together and then applied to the collar 241. In still another embodiment, the collar 241, first sleeve 242, and second sleeve 249 are bonded together (e.g., in a mold) and the bonded unit is applied to the handle core 211. Of course, in this instance (or others), one or more of the steps described above may be deleted and/or modified, with the possibility of other steps included. All such variations and combinations thereof are intended to fall within the scope of the present disclosure.

While only a few specific example embodiments are shown and described throughout this disclosure, the embodiments illustrated in the figures are shown by way of example, and any of a wide variety of other striking member configurations (e.g., a mallet, hatchet, etc.) will be readily apparent to a person of ordinary skill in the art after reviewing this disclosure. All such variations of one-hand or two-hand operated striking tools are intended to be within the scope of the disclosure. It is important to note that the construction and arrangement of the elements of the hand operated striking tool, shown as a sledgehammer, with a vibration reduction mechanism is illustrative only. Although only a few embodiments have been described in detail in this disclosure, those skilled in the art who review this disclosure will readily appreciate that many modifications are possible without materially departing from the novel teachings and advantages of the subject matter recited.

Accordingly, all such modifications are intended to be included within the scope of the present disclosure. Other substitutions, modifications, changes and omissions may be made in the design, operating conditions and arrangement of the preferred and other exemplary embodiments without departing from the spirit of the present disclosure. For example, the shape of the hole of the tool head and the exterior of the vibration reduction mechanism may be varied as necessary to accommodate changes in the dimensions, shape and geometry of the other components of the striking tool.

Finally, the order or sequence of any process or method steps may be varied or re-sequenced according to alternative embodiments. Other substitutions, modifications, changes and omissions may be made in the design, operating configuration and arrangement of the preferred and other exemplary embodiments without departing from the spirit of the present disclosure as expressed in the appended claims.

What is claimed is:

1. A hand operated striking tool, comprising:

a handle having a first end portion and a second end portion, wherein the second end portion defines a user interface portion of the handle;

a tool head defining a hole; and a vibration reduction mechanism positioned on or near the first end portion of the handle, wherein at least part of the vibration reduction mechanism is disposed between the handle and the tool head, wherein the vibration reduction mechanism fits substantially within the hole of the tool head to form an intermediary between the tool head and the handle, and wherein the vibration reduction mechanism includes:

a collar coupled to the handle, the collar is formed from a metal-based material to have a tube configuration surrounding the handle and extends towards the second end portion;

at least one sleeve having a sleeve material interposed over the collar to completely decouple the handle from the tool head;

a retainer that extends at least partly through the tool head and engages with each of the handle, the at least one sleeve, and the collar;

wherein at least said retainer is arranged entirely within the hole of the tool head, wherein an engagement of the retainer with each of the collar and the handle defines a gap separating the retainer from each of the handle and the collar, wherein the gap is at least partly filled with the sleeve material of the at least one sleeve which completely decouples the handle from the tool head, and wherein the striking tool comprises a lower placed pin proximate the second end portion and engaging the handle and the collar.

2. The tool of claim 1, wherein the gap decouples the tool head from the handle.

3. The tool of claim 2, wherein the retainer includes a rivet.

4. The tool of claim 1, wherein the collar extends towards the user interface portion of the handle further than the at least one sleeve.

5. A hand operated striking tool, comprising:

a handle having a user interface portion;

a tool head defining a tapered hole; and a vibration reduction mechanism positioned in between the tool head and the handle, wherein the vibration reduction mechanism fits substantially within the hole of the tool head and wherein the vibration reduction mechanism includes:

a collar, the collar is coupled to the handle and is formed from a metal-based material to have a tube configuration surrounding the handle and extends towards the user interface portion;

a pin coupled to the collar and to the handle, and which extends at least partly through the tool head; and at least one sleeve formed from a sleeve material interposed over the collar to completely decouple the handle from the tool head, wherein an outer sleeve of the at least one sleeve engages with the tapered hole of the tool head;

wherein at least said pin is arranged entirely within the hole of the tool head, wherein an engagement of the pin with each of the collar and the handle defines a gap separating the pin from each of the handle and the collar, wherein the gap is at least partly filled with the sleeve material of the at least one sleeve which completely decouples the handle from the tool head, and wherein the striking tool comprises a lower placed pin proximate the user interface portion and engaging the handle and the collar.

6. The tool of claim 5, wherein the tapered hole has a first taper angle and a second taper angle, wherein the first taper angle is different from the second taper angle; and wherein the at least one sleeve includes a first sleeve and the outer sleeve, wherein the outer sleeve is disposed over the first sleeve.

7. The tool of claim 6, wherein an outer profile of the outer sleeve is tapered and includes a first outer sleeve taper angle that transitions to a second outer sleeve taper angle, wherein the first outer sleeve taper angle substantially matches the first taper angle of the tapered hole, and wherein the second outer sleeve taper angle substantially matches the second taper angle of the tapered hole.

8. The tool of claim 6, wherein the first sleeve is formed from a material that has an approximate 30-60 Shore A durometer value, such that the first sleeve isolates a first vibration spectrum.

9. The tool of claim 8, wherein the outer sleeve is formed from a material that has an approximate 60-100 Shore A durometer value, such that the outer sleeve isolates a second vibration spectrum, wherein the second vibration spectrum is different from the first vibration spectrum.

10. The tool of claim 5, wherein the outer sleeve includes one or more circumferential ridges that securably engage with the tool head.

* * * * *